US010353337B2

(12) United States Patent
Momoka et al.

(10) Patent No.: US 10,353,337 B2
(45) Date of Patent: Jul. 16, 2019

(54) IMAGE FORMING APPARATUS INCLUDING OPTICAL PRINT HEAD

(71) Applicant: CANON KABUSHIKI KAISHA, Tokyo (JP)

(72) Inventors: Toshiki Momoka, Tokyo (JP); Daisuke Aruga, Abiko (JP); Hitoshi Iwai, Abiko (JP); Shinichiro Hosoi, Tokyo (JP); Takehiro Ishidate, Tokyo (JP); Yuya Tamura, Tsukuba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/166,530

(22) Filed: Oct. 22, 2018

(65) Prior Publication Data

US 2019/0129354 A1 May 2, 2019

(30) Foreign Application Priority Data

Oct. 27, 2017 (JP) ..... 2017-208426

(51) Int. Cl.

| | |
|---|---|
| ***G03G 21/16*** | (2006.01) |
| ***G03G 21/18*** | (2006.01) |
| ***G03G 15/00*** | (2006.01) |
| ***G03G 15/04*** | (2006.01) |

(52) U.S. Cl.

CPC ..... *G03G 21/1647* (2013.01); *G03G 15/0409* (2013.01); *G03G 15/751* (2013.01); *G03G 21/1666* (2013.01); *G03G 21/1814* (2013.01); *G03G 21/1842* (2013.01); *G03G 15/04072* (2013.01); *G03G 2221/1609* (2013.01)

(58) Field of Classification Search

CPC ..... G03G 15/04; G03G 15/04036; G03G 15/04072; G03G 15/0409; G03G 15/751; G03G 21/1647; G03G 21/1666; G03G 21/1814; G03G 21/1842; G03G 2221/1609

See application file for complete search history.

(56) References Cited

U.S. PATENT DOCUMENTS

| | | | | |
|---|---|---|---|---|
| 2013/0170855 | A1* | 7/2013 | Mori | G03G 15/0189 399/110 |
| 2014/0212170 | A1* | 7/2014 | Kato | G03G 21/1666 399/118 |
| 2015/0050043 | A1* | 2/2015 | Sato | G03G 21/1633 399/110 |

FOREIGN PATENT DOCUMENTS

JP 2009-237368 A 10/2009

* cited by examiner

*Primary Examiner* — Hoang X Ngo
(74) *Attorney, Agent, or Firm* — Venable LLP

(57) ABSTRACT

An image forming apparatus includes an optical print head, an optical print head moving mechanism, an abutting portion, a projected portion, an opposing portion, and a preventing portion provided on the projected portion so that in a state in which a drum cartridge is dismounted from a main assembly of the image forming apparatus, the preventing portion is contacted to the opposing portion by movement of the optical print head moved by the moving mechanism toward a side downstream of the exposure position with respect to the movement direction and prevents further movement of the optical print head in the movement direction and so that in a state in which the drum cartridge is mounted in the main assembly and the abutting portion contacts the drum cartridge, the preventing portion is in non-contact with the opposing portion.

13 Claims, 14 Drawing Sheets

DIRECTION FROM REAR TO FRONT : FRONT
DIRECTION FROM FRONT TO REAR : REAR (a)

(b)

IMAGE FORMING APPARATUS INCLUDING OPTICAL PRINT HEAD

FIELD OF THE INVENTION AND RELATED ART

The present invention relates to an image forming apparatus including an optical print head movable between an exposure position where a projected portion is exposed to light and a retracted position retracted further from the photosensitive drum than when in the exposure position in order to allow exchange of a device.

In image forming apparatuses such as a printer and a copying machine, there is an image forming apparatus provided with a plurality of light emitting elements for exposing a photosensitive drum to light. The optical print head includes an LED (light emitting diode), an organic EL (electro-luminescence) device or the like as an example of a light emitting element (device), and an optical print head in which the light emitting elements are arranged along a rotational axis direction of the photosensitive drum in a row (line) or in a plurality of (two) rows (lines) with a staggered pattern has been known. Further, the optical print head includes a plurality of lenses for focusing light beams, emitted from the plurality of light emitting elements, onto the photosensitive drum. The plurality of lenses are disposed opposed to the surface of the photosensitive drum so as to extend along an arrangement direction of the light emitting elements between the light emitting elements and the photosensitive drum. The light beams emitted from the plurality of light emitting elements are focused on the surface of the photosensitive drum through the lenses. As a result, an electrostatic latent image is formed on the surface of the photosensitive drum.

The photosensitive drum is a consumable, and therefore is exchanged periodically. For that reason, a drum cartridge including the photosensitive drum is constituted so as to be mountable to and dismountable from an image forming apparatus main assembly. An operator such as a user or service person can perform maintenance of the image forming apparatus by exchanging the drum cartridge with a new drum cartridge by extracting the drum cartridge from the apparatus main assembly and then inserting the new drum cartridge into the apparatus main assembly.

When the photosensitive drum is exposed to light, the optical print head moves to the exposure position where the optical print head is close to a surface of the photosensitive drum and opposes the surface of the photosensitive drum. When the optical print head is in the exposure position, a gap (interval) between the lenses and the photosensitive drum surface is very narrow (small). Therefore, there is a liability that during exchange of the drum cartridge, when the optical print head is retracted from the exposure position, the optical print head and the photosensitive drum or the like contact each other and thus the photosensitive drum surface or lens surfaces are damaged. Therefore, there is a need to provide the image forming apparatus with a mechanism for reciprocating the optical print head between the exposure position and a retracted position where the optical print head is further retracted from the drum cartridge than when in the exposure position in order to exchange the drum cartridge.

In general, for example, a projection such as a pin projects from a side, where the drum cartridge is provided, at each of both end portions of the optical print head with respect to a longitudinal direction of the optical print head. These projections abut against, for example, a frame of the drum cartridge, and thus a gap is formed between a lens array and the photosensitive drum surface, so that the optical print head is in the exposure position. As an example of a means for determining a position of the optical print head relative to the photosensitive drum, for example, there is a means as disclosed in Japanese Laid-Open Patent Application (JP-A) 2009-237368.

JP-A 2009-237368 discloses a constitution in which an LED print head (LPH) 14 is reciprocated by a raising and lowering member 17 between an exposure position which is a position during image formation and a position further retracted from a photosensitive drum 12 than when in the exposure position. As shown in FIG. 9 of JP-A 2009-237368, on a front side of the raising and lowering member 17, a lever 172 is provided, and in interrelation with movement of the lever 172 in an arrow C direction and an arrow D direction, the raising and lowering member 17 moves the LPH 14 in an arrow Z direction. In interrelation with the movement of the lever 172 in the arrow C direction, the LPH 14 is moved from the retracted position toward the exposure position, and in interrelation with movement of the lever 172 in the arrow D direction, the LPH 14 is moved from the exposure position toward the retracted position.

On a front side of the LPH 14, a first front positioning pin 611F is provided for positioning a front side position of the LPH 14 relative to the photosensitive drum 12 with respect to the Z direction. Further, on a rear side of the LPH 14, a first rear positioning pin 611R is provided for positioning a rear side position of the LPH 14 relative to the photosensitive drum 12 with respect to the Z direction. The LPH 14 moved from the retracted position toward the exposure position is in the exposure position by contact of the first front positioning pin 611F and the first rear positioning pin 611R with a frame of a photosensitive member module PM.

Further, on the front side of the LPH 14, a second front positioning pin 612F is provided adjacently to the first front positioning pin 611F. The second front positioning pin 612F projects from an upper side and a lower side of the LPH 14 on the front side of the LPH 14. The second front positioning pin 612F projecting from the upper side of the LPH 14 is, as shown in FIG. 6, sandwiched in a U-shaped receiving groove of a front positioning member 84 fixed to a main assembly of an image forming apparatus 1. As a result, the LPH 14 is prevented from moving in an arrow Y direction. On the other hand, the second front positioning pin 612F projecting from the lower side of the LPH 14 is, as shown in FIG. 7, sandwiched in a U-shaped receiving groove of a front pressing member 180 fixed to a main assembly of an image forming apparatus 1. As a result, the LPH 14 is prevented from moving in an arrow X direction.

By the constitution described above, the LPH 14 can be moved from the retracted position to the exposure position in a state in which movement of the LPH 14 in the arrow Y direction and the arrow X direction is prevented (limited) by the front positioning member 84 and the front pressing member 180.

However, in a structure of the second front positioning pin 612F disclosed in JP-A 2009-237368, the following problem arises in a state in which the photosensitive member module PM is dismounted from the apparatus main assembly.

In the case where the LPH 14 is moved from the retracted position to the exposure position, there is a liability that due to a mounting error between the raising and lowering mechanism 17 and the front pressing member 180 and part tolerances of the raising and lowering member 17 and the LPH 14, the second front positioning pin 612F is disengaged from the U-shaped groove of the front pressing member 180.

SUMMARY OF THE INVENTION

According to an aspect of the present invention, there is provided an image forming apparatus in which a drum cartridge including a rotatable photosensitive drum is capable of being mounted in and dismounted from a main assembly, the image forming apparatus comprising: an optical print head including a light emitting element configured to emit light to which the photosensitive drum is exposed; a moving mechanism configured to move the optical print head from a retracted position retracted from the photosensitive drum so as to exchange the photosensitive drum toward a direction in which the optical print head approaches the photosensitive drum; an abutting portion provided in the optical print head and configured to position the optical print head in an exposure position where the photosensitive drum is exposed to light emitted from the light emitting element, by being abutted against the drum cartridge in a mounted state in the main assembly during movement of the optical print head by the moving mechanism; a projected portion extending from the optical print head toward a side opposite from a side where the drum cartridge is provided, the projected portion being provided on at least one of one end side and the other end side of the optical print head with respect to a longitudinal direction of the optical print head; an opposing portion fixed to the main assembly so as to oppose a part of the projected portion with respect to a perpendicular direction perpendicular to a movement direction of the optical print head moved by the moving mechanism, wherein the opposing portion guides movement of the optical print head in the movement direction by contact thereof with the projected portion with respect to the perpendicular direction during movement of the optical print head from the retracted position toward the exposure position; and a preventing portion provided on the projected portion so that in a state in which the drum cartridge is dismounted from the main assembly, the preventing portion is contacted to the opposing portion by movement of the optical print head moved by the moving mechanism toward a side downstream of the exposure position with respect to the movement direction and prevents further movement of the optical print head in the movement direction and so that in a state in which the drum cartridge is mounted in the main assembly and the abutting portion contacts the drum cartridge, the preventing portion is in non-contact with the opposing portion.

Further features of the present invention will become apparent from the following description of exemplary embodiments with reference to the attached drawings.

Figure 2:
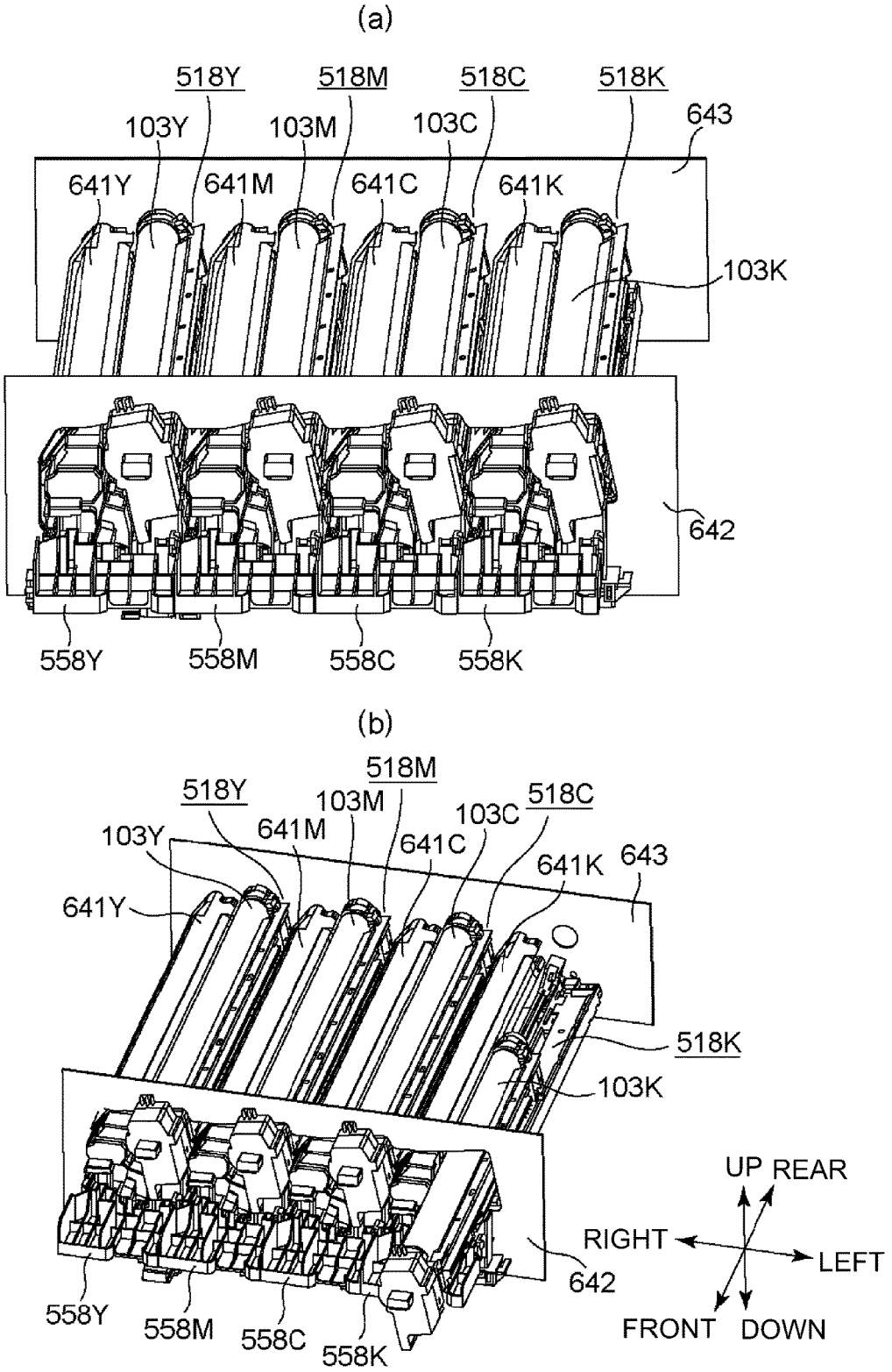

Parts (a) and (b) of FIG. 2 are schematic perspective views showing a drum unit and a periphery thereof in the image forming apparatus.

Figure 3:
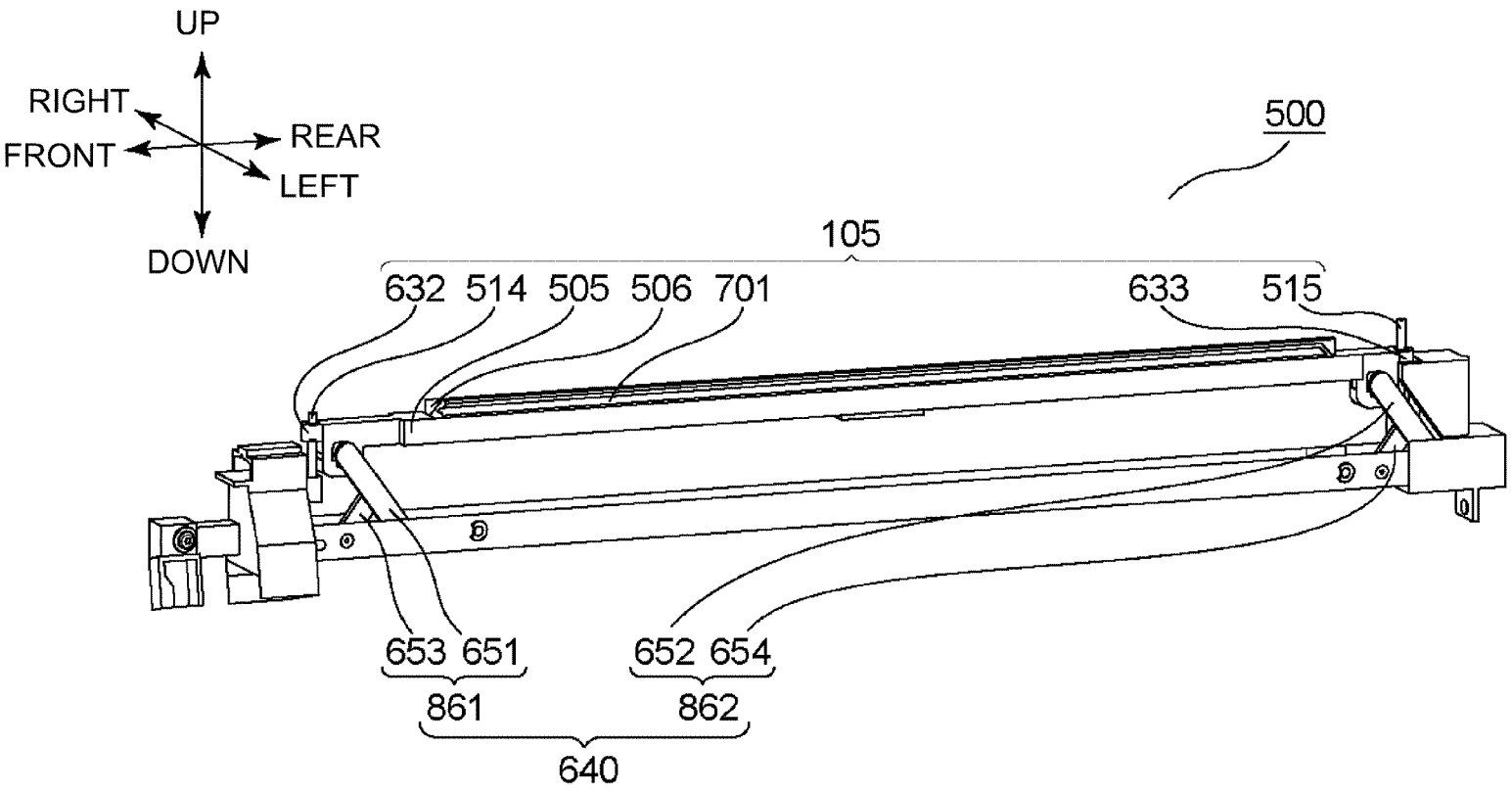

FIG. 3 is a schematic perspective view of an exposure unit.

Figure 4:
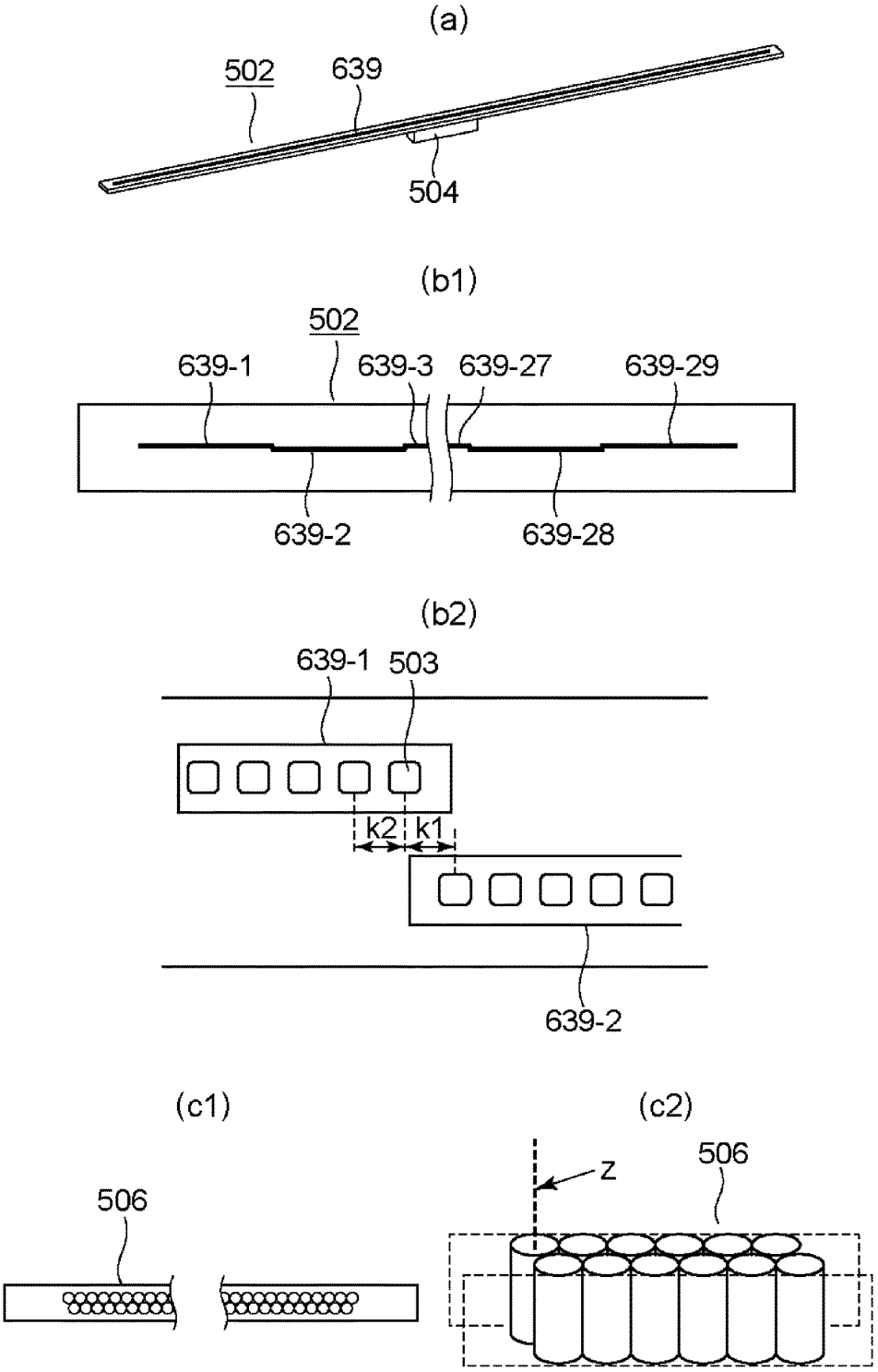

Parts (a), (b1), (b2), (c1) and (c2) of FIG. 4 are schematic views for illustrating a substrate, an LED chip or a lens array of an optical print head.

Figure 5:
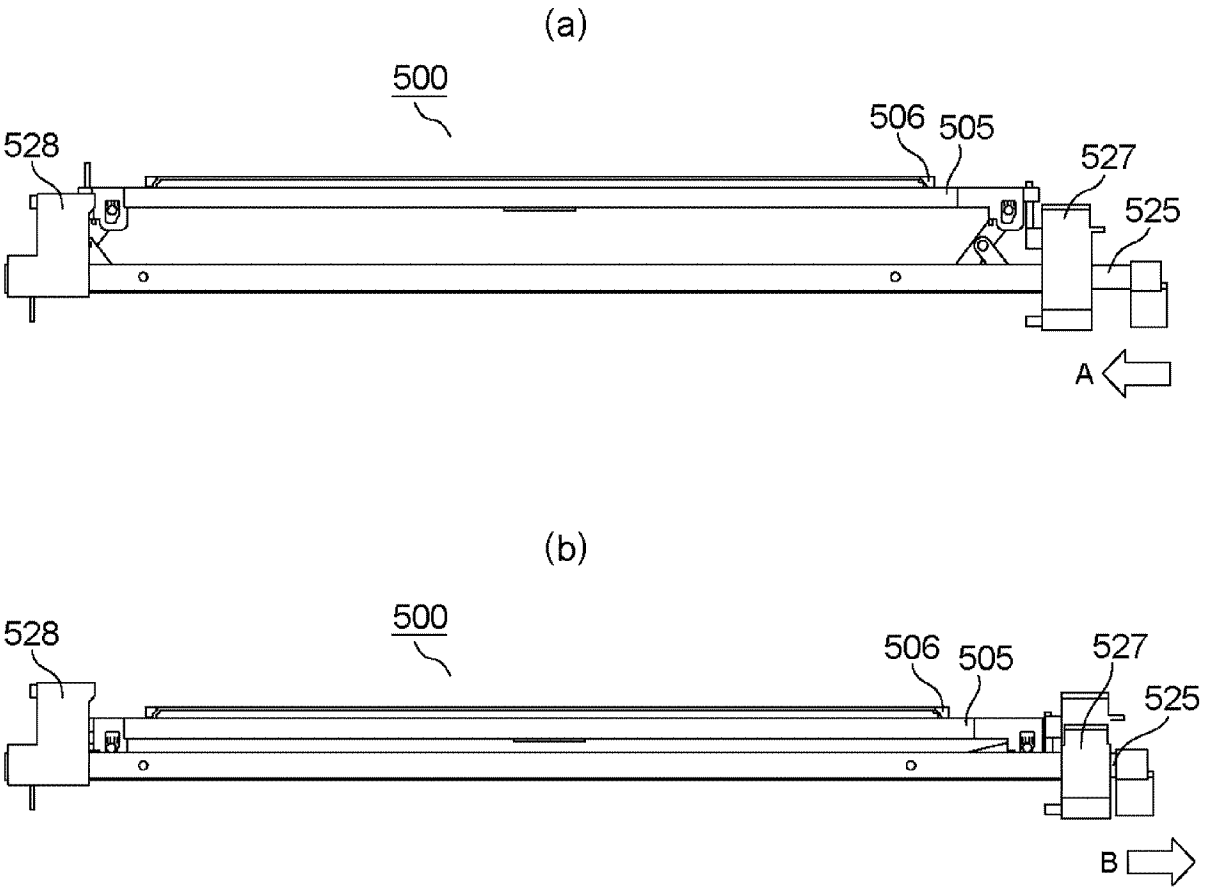

Parts (a) and (b) of FIG. 5 are side views of the optical print head.

Figure 6:
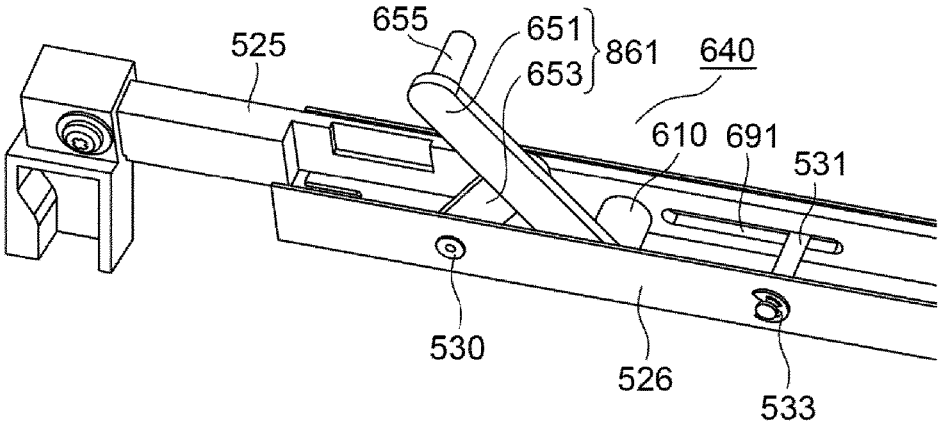
Figure 6:
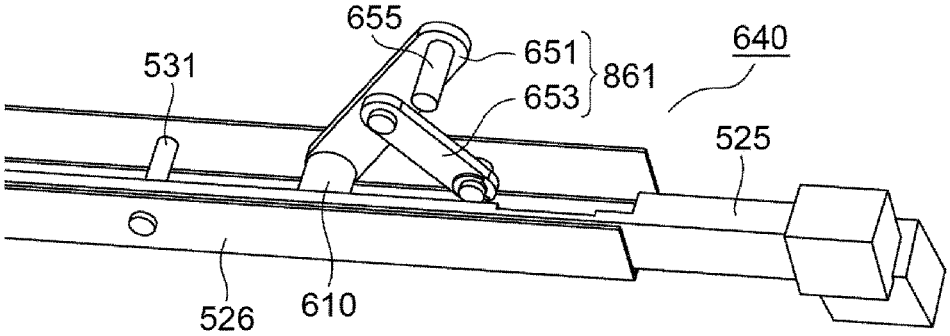

Parts (a) and (b) of FIG. 6 are perspective views of a moving mechanism.

Figure 7:
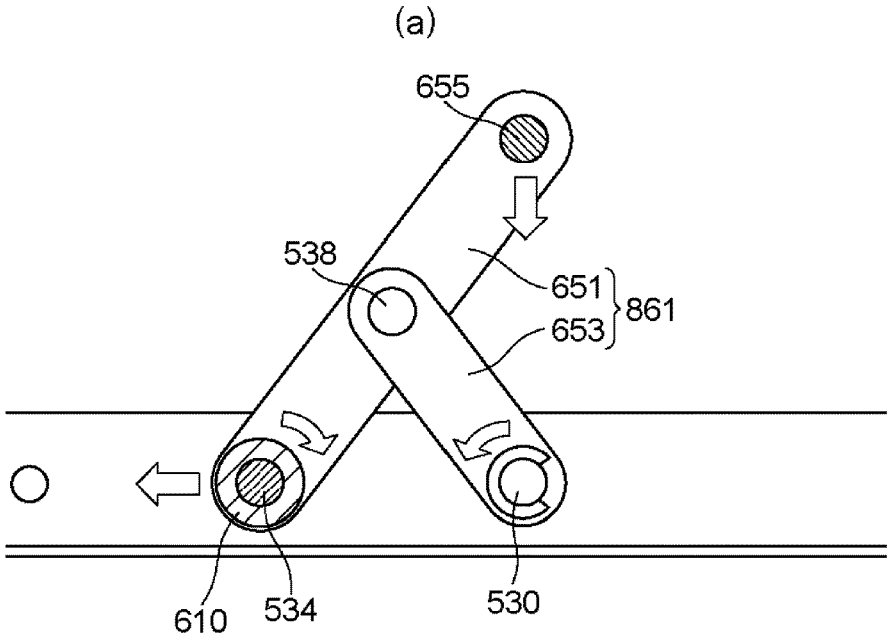
Figure 7:
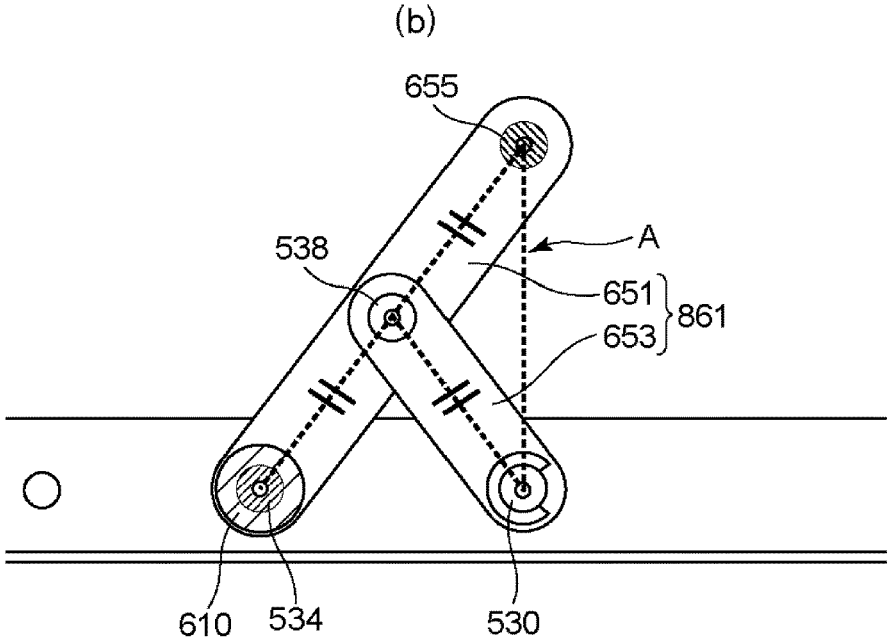

Parts (a) and (b) of FIG. 7 are side views of a first link mechanism of λ type.

Figure 8:
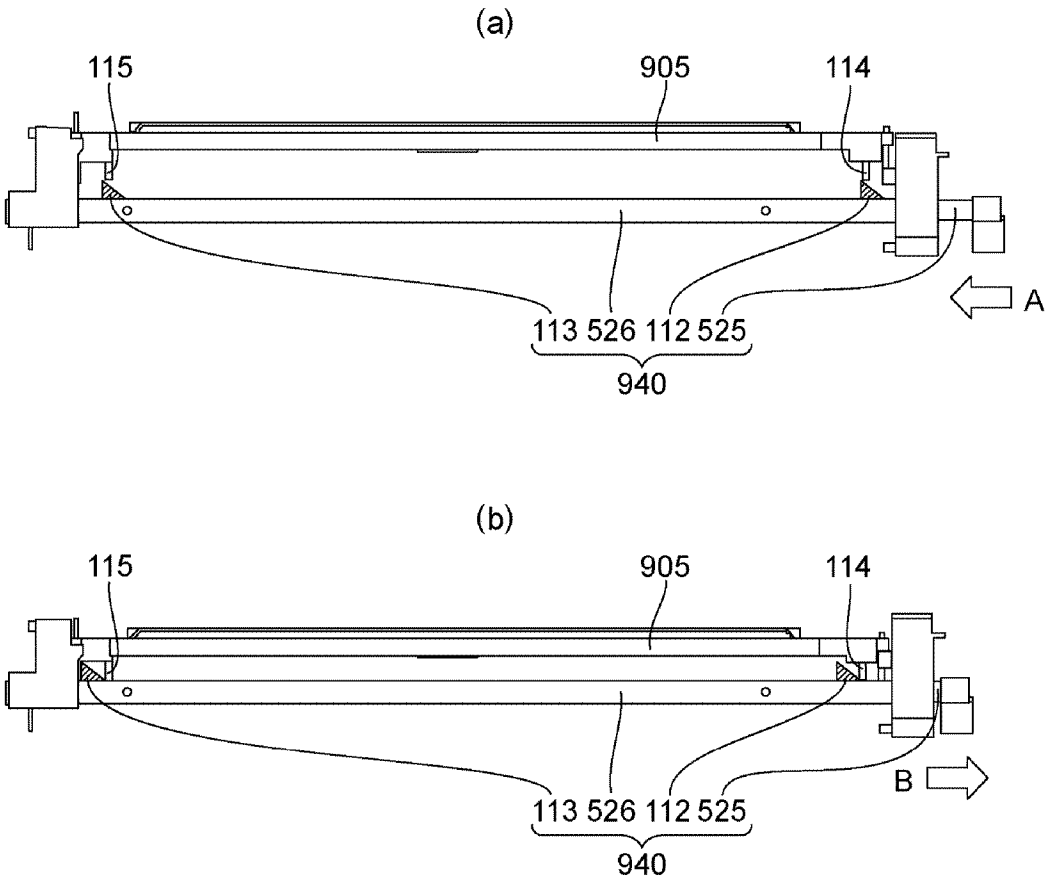

Parts (a) and (b) of FIG. 8 are schematic views for illustrating the moving mechanism using a cam mechanism.

Figure 9:
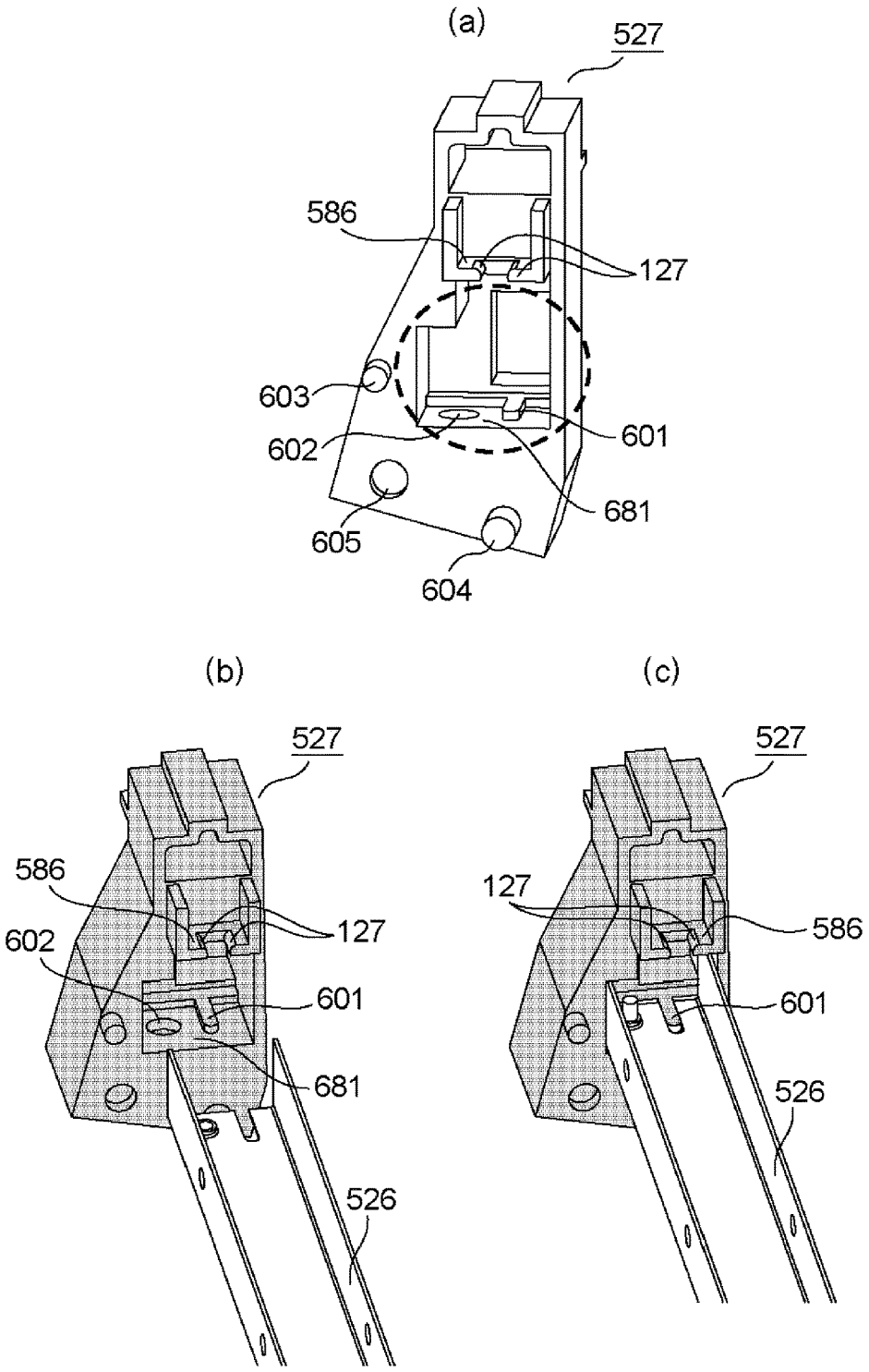

Parts (a), (b) and (c) of FIG. 9 are perspective views of a first supporting portion and a third supporting portion.

Figure 10:
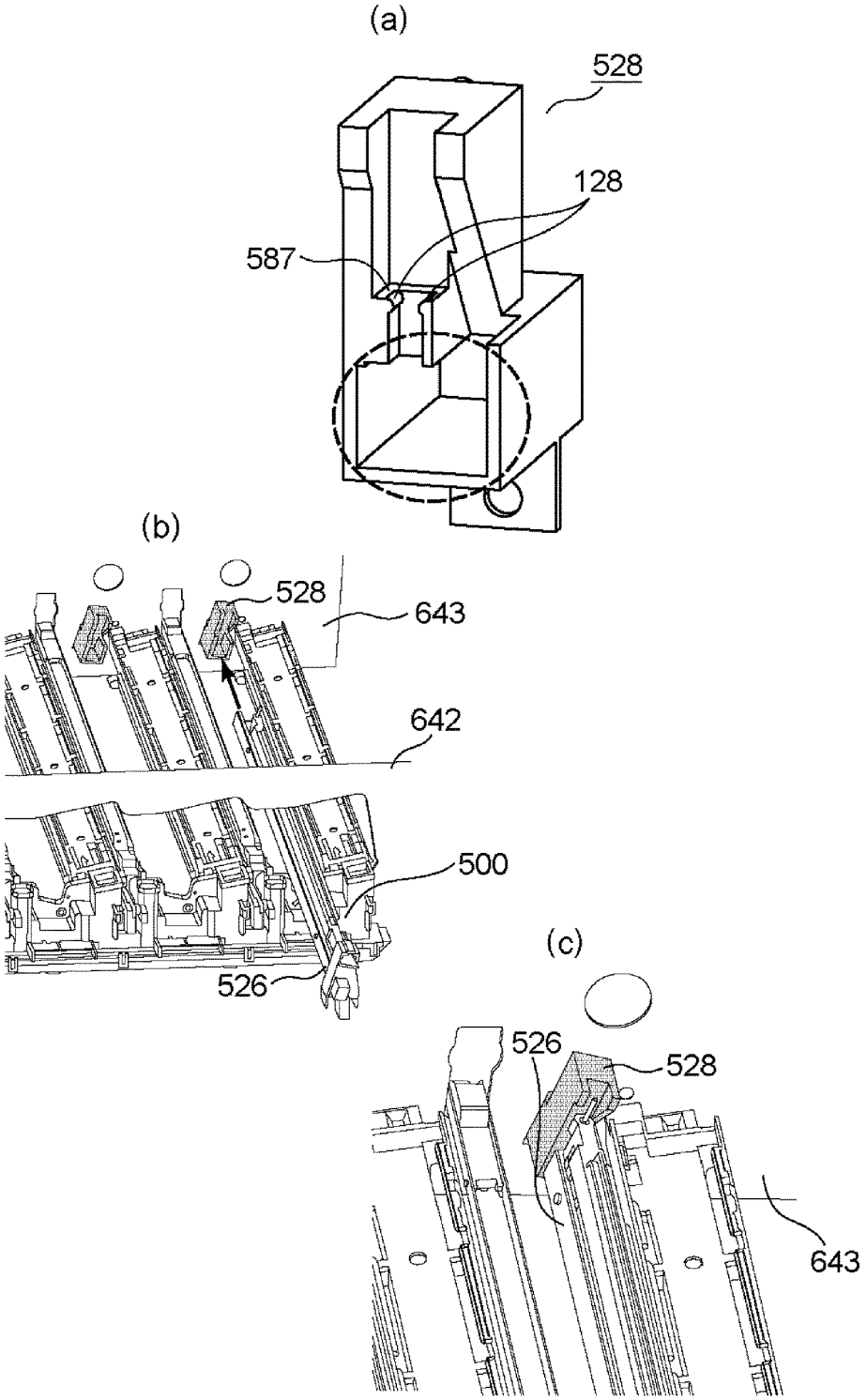

Parts (a), (b) and (c) of FIG. 10 are perspective views of a second supporting portion, a rear side plate and an exposure unit mounted on the second supporting portion.

Figure 11:
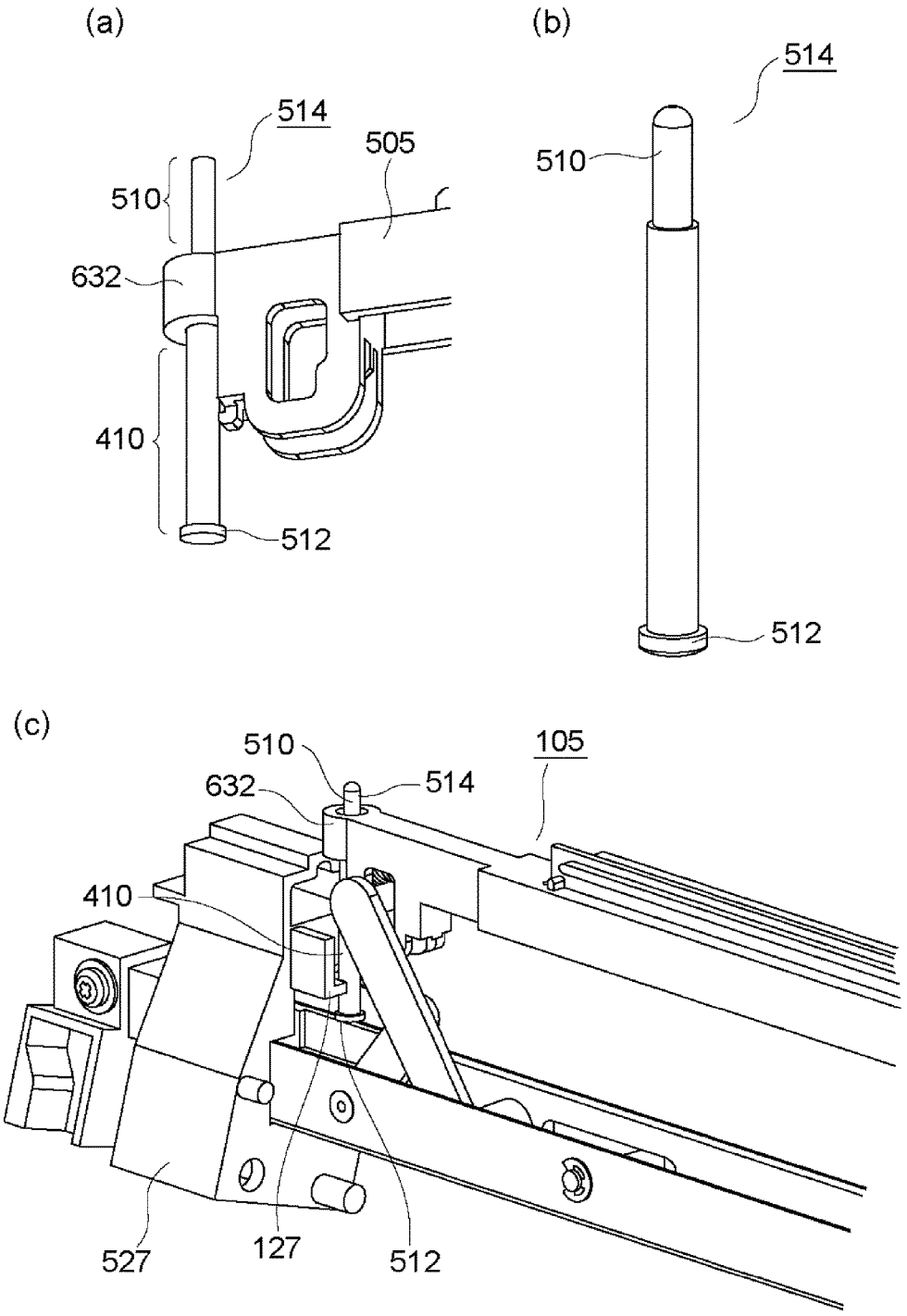

Parts (a), (b) and (c) of FIG. 11 are schematic views for illustrating a structural feature of a projected portion and a wall portion.

Figure 12:
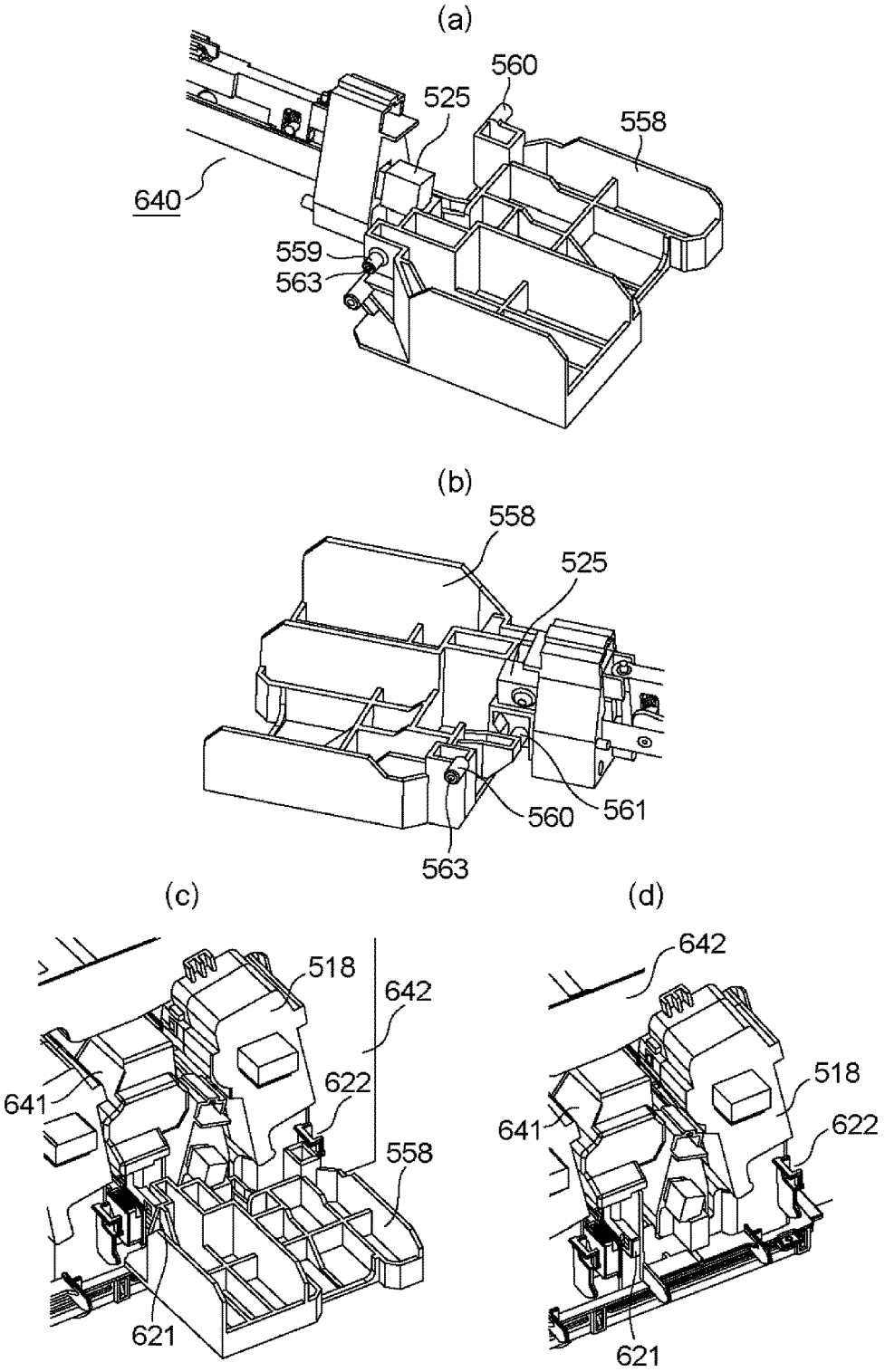

Parts (a) to (d) of FIG. 12 are perspective views of a cover.

Figure 13:
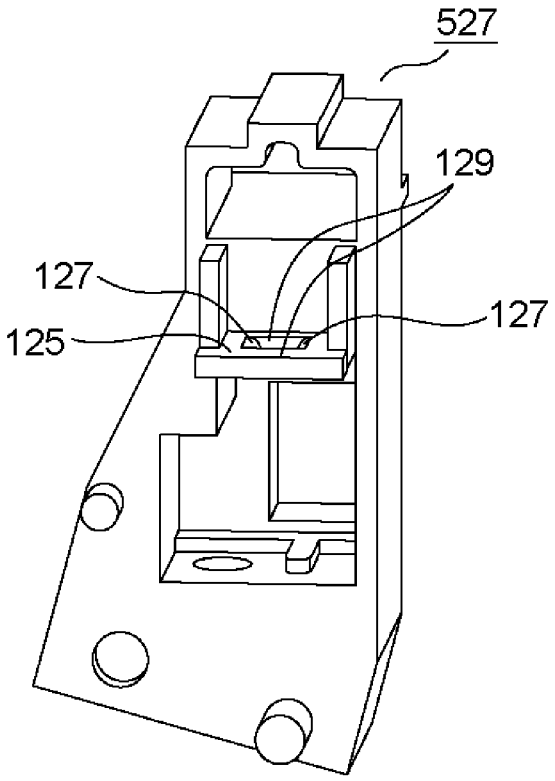

FIG. 13 is a schematic view for illustrating a wall portion in another embodiment.

Figure 14:
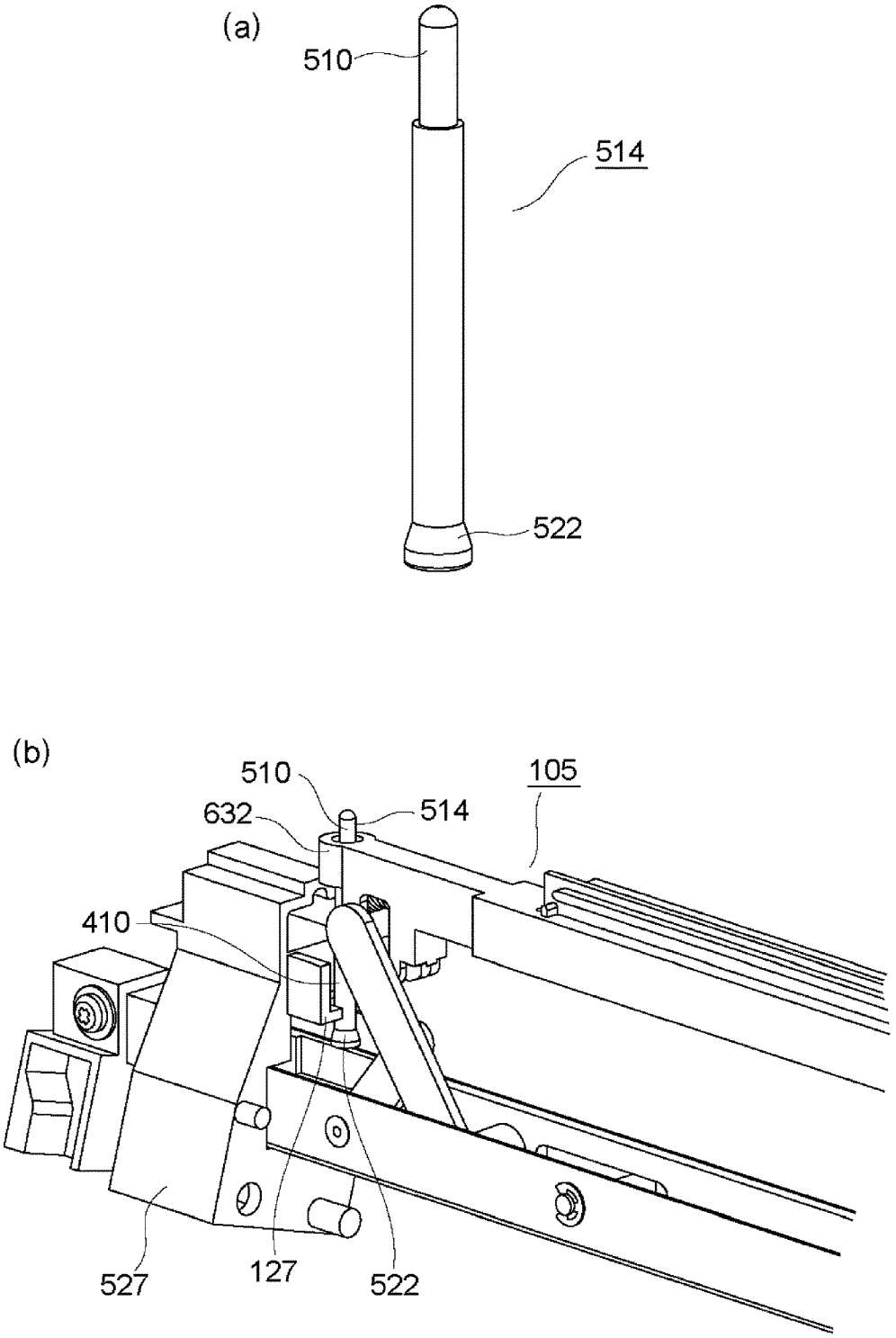

Parts (a) and (b) of FIG. 14 are schematic views for illustrating a projected portion in a modified embodiment.

DESCRIPTION OF EMBODIMENTS

In the following, embodiments for carrying out the present invention will be described using the attached drawings. However, constituent elements described in the following embodiments are merely examples, and the present invention is not limited to those in the following embodiments.

Embodiment 1

(Image Forming Apparatus)

Figure 1:
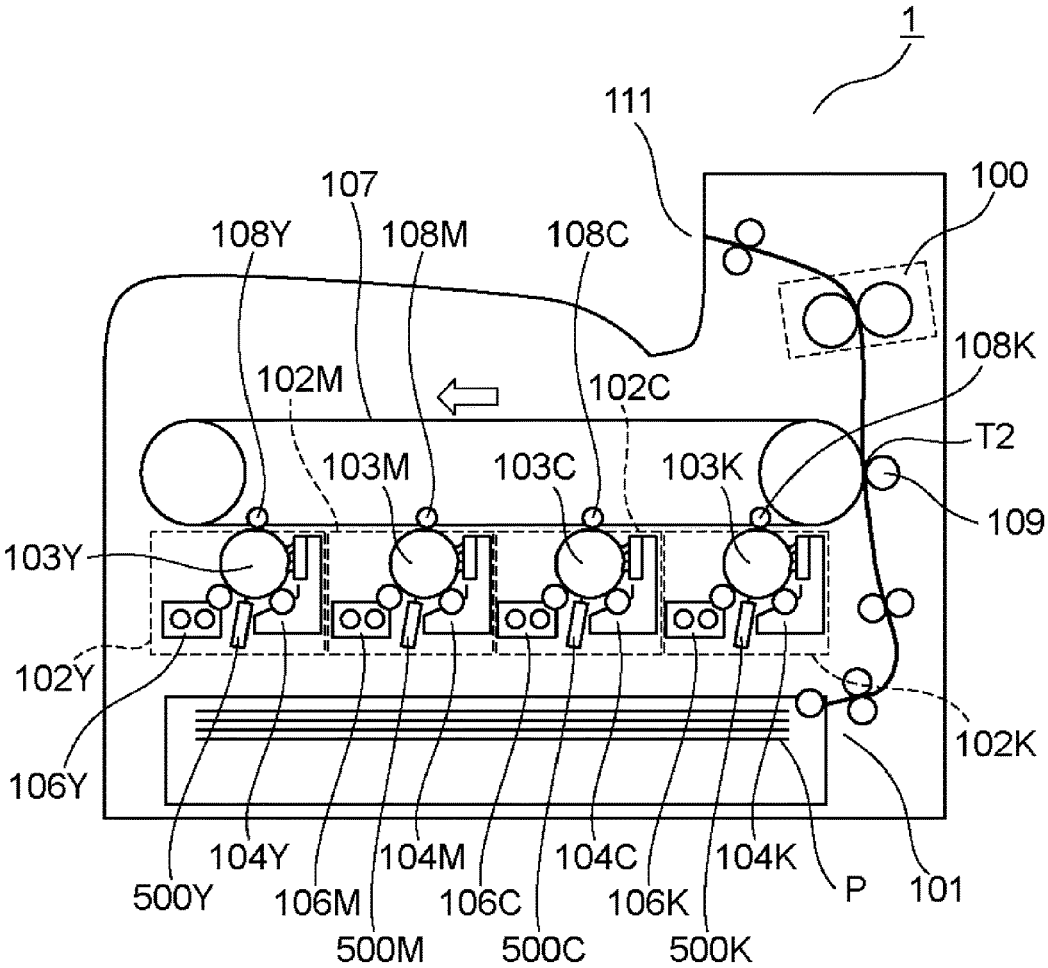
FIG. 1 is a schematic sectional view showing an image forming apparatus.
Figure 1:
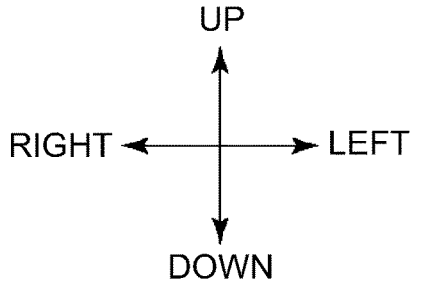

First, a schematic structure of an image forming apparatus 1 will be described. FIG. 1 is a schematic sectional view of the image forming apparatus 1. The image forming apparatus 1 shown in FIG. 1 is a color printer (SFP: single function printer) including no reading device but may also be a copying machine including a reading device. Further, the image forming apparatus in this embodiment is not limited to a color image forming apparatus including a plurality of photosensitive drums 103 as shown in FIG. 1 but may also be a color image forming apparatus including a single photosensitive drum 103 or an image forming apparatus for forming a monochromatic image.

The image forming apparatus 1 shown in FIG. 1 includes four image forming portions 102Y, 102M, 102C and 102K (hereinafter collectively referred simply to as also a "image forming portion 102") for forming toner images of yellow, magenta, cyan and black, respectively. The image forming portions 102Y, 102M, 102C and 102K include photosensitive drums 103Y, 103M, 103C and 103K ("photosensitive drum 103"), and charging devices 104Y, 104M, 104C and 104K ("charging device 104") for electrically charging the photosensitive drums 103Y, 103M, 103C and 103K, respectively. The image forming portions further include LED (light emitting diode) exposure units 500Y, 500M, 500C and 500K ("exposure unit 500") as light sources for emitting light (beams) to which the photosensitive drums 103Y, 103M, 103C and 103K are exposed, respectively, and developing devices 106Y, 106M, 106C and 106K ("developing device 106") each for developing an electrostatic latent image on the photosensitive drum 103 with toner into a toner image of an associated color on the photosensitive drum 103. Incidentally, suffixes Y, M, C and K of the respective constituent elements represent colors of the toners.

The image forming apparatus 1 includes an intermediary transfer belt 107 onto which the toner images formed on the photosensitive drums 3 are to be transferred and primary transfer rollers 108 (Y, M, C, K) for successively transferring the toner images from the photosensitive drums 103 onto the intermediary transfer belt 107. The image forming apparatus 1 further includes a secondary transfer roller 109 for transferring the toner images from the intermediary transfer belt 107 onto recording paper P fed from a paper feeding portion 101 and includes a fixing device 100 for fixing the secondary-transferred toner images on the recording paper P.

(Image Forming Process)

The exposure unit 500 exposes to light the surface of the photosensitive drum 103Y charged by the charging device 104Y. As a result, the electrostatic latent image is formed on the photosensitive drum 103Y. Then, the developing device 106Y develops the electrostatic latent image, formed on the photosensitive drum 103Y, with yellow toner. A resultant yellow toner image formed on the photosensitive drum 103Y through development of the electrostatic latent image is transferred onto the intermediary transfer belt 107 by the primary transfer roller 108Y. The toner images of magenta, cyan and black are also transferred onto the intermediary transfer belt 107 by a similar image forming process.

The respective color toner images transferred on the intermediary transfer belt 107 are fed to a secondary transfer portion T2 by the intermediary transfer belt 107. To the secondary transfer roller 109 disposed at the secondary transfer portion T2, a transfer bias for transferring the toner images onto the recording paper P has been applied. The toner images fed to the secondary transfer portion T2 are transferred, onto the recording paper P fed from the paper feeding portion 101, under application of the transfer bias to the secondary transfer roller 109. The recording paper P on which the toner images are transferred is fed to the fixing device 100. The fixing device 100 fixes the toner images on the recording paper P by heat and pressure. The recording paper P subjected to a fixing process by the fixing device 100 is discharged onto a paper discharge portion 111.

(Drum Unit and Developing Unit)

In the image forming apparatus 1 of this embodiment, a drum unit 518 which is an example of a drum cartridge is mounted. The drum unit 518 is a cartridge to be exchanged by an operator such as a user or a maintenance person. The drum unit 518 (Y, M, C, K) in this embodiment includes the photosensitive drum 103 (Y, M, C, K) rotatably supported by a frame thereof. However, the drum unit 518 may also have a constitution in which the charging unit 104 and a cleaning device are not provided.

Further, in the image forming apparatus 1 of this embodiment, a developing unit 641 which is a separate member from the drum unit 518 is mounted. The developing unit 641 is a cartridge prepared by integrally assembling the developing device 106 shown in FIG. 1 and a toner accommodating portion into a unit. The developing device 106 includes a developing sleeve which is a developer carrying member for carrying a developer (toner and a carrier). The developing unit 641 is provided with a plurality of gears for rotating a screw for stirring the toner and the carrier. When these gears are aging-deteriorated or the like, the operator dismounts the developing unit 641 from the apparatus main assembly of the image forming apparatus 1 and exchanges the developing unit 641 with new one. Incidentally, the forms of the drum unit 518 and the developing unit 641 may also be a process cartridge prepared by integrally assembling the drum unit 518 and the developing unit 641 into a unit.

Part (a) of FIG. 2 is a perspective view showing a schematic structure of the drum unit 518, the developing unit 641 and peripheral portions thereof. Part (b) of FIG. 2 is a perspective view showing a state in which the drum unit 518 is being inserted from an outside of the apparatus main assembly into the image forming apparatus 1.

As shown in part (a) of FIG. 2, the image forming apparatus 1 includes a front side plate 642 formed with a metal plate and a rear side plate 643 formed with a metal plate. The front side plate 642 is a side wall provided on a front side of the image forming apparatus 1. The rear side plate 643 is a side wall provided on a rear side of the image forming apparatus 1. As shown in part (a) of FIG. 2, the front side plate 642 and the rear side plate 643 are disposed opposed to each other, and an unshown metal plate as a beam is bridged between these plates. Each of the front side plate 642, the rear side plate 643 and the unshown beam constitutes a part of a frame of the image forming apparatus 1.

The front side plate 642 is provided with an opening through which the drum unit 518 and the developing unit 641 can be inserted from the front side into and extracted from the image forming apparatus 1. The drum unit 518 and the developing unit 641 are mounted at a predetermined position of the main assembly of the image forming apparatus 1 through the opening (mounting position). Further, the image forming apparatus 1 includes a cover 558 (Y, M, C, K) for covering a front side of both of the drum unit 518 and the developing unit 641 which are mounted in the mounting position. The cover 558 is fixed at one end thereof to the main assembly of the image forming apparatus 1 by a hinge, whereby the cover 558 is rotatable relative to the main assembly of the image forming apparatus 1. The operator for performing maintenance opens the cover 558 and takes the drum unit 518 or the developing unit 641 out of the image forming apparatus 1, and then inserts a new drum unit 518 or a new developing unit 641 into the image forming apparatus 1 and closes the cover 558, whereby an exchanging operation is completed. The cover 558 will be further specifically described later.

Here, as shown in parts (a) and (b) of FIG. 2, in the following description, the front side plate 642 side and the rear side plate 643 side are defined as a front side and a rear side, respectively. Further, when a position of the photosensitive drum 103K on which the electrostatic latent image relating to the black toner image is formed is taken as a reference position, a side where the photosensitive drum 103Y on which the electrostatic latent image relating to the yellow toner image is formed is disposed is defined as a right side. Further, when a position of the photosensitive drum 103Y is taken as a reference position, a side where the photosensitive drum 103K is disposed is defined as a left side. Further, with respect to a direction perpendicular to a front-rear direction and a left-right direction, an upward direction in a vertical direction is defined as an up direction and a downward direction in the vertical direction is defined as a down direction. The front direction, the rear direction, the right direction, the left direction, the up direction and the down direction defined above are shown in part (b) of FIG. 2. Further, in the following description, with respect to a rotational axis direction of the photosensitive drum 3, one end side means the front side and the other end side means the rear side. Further, one end side and the other end side with respect to the front-rear direction also correspond to the front side and the rear side, respectively. Further, with respect to the left-right direction, one end side means the right side and the other end side means the left side.

(Exposure Unit)

Next, the exposure unit 500 including an optical print head 105 will be described. Here, as an example of an exposure type employed in an image forming apparatus of an electrophotographic type, there is a laser beam scanning exposure type in which a beam emitted from a semiconductor laser is deflected for scanning by a rotating polygon mirror and the photosensitive drum 1 is exposed to the beam through an f-θ lens or the like. The "optical print head 105" described in this embodiment is used in an LED exposure type in which the photosensitive drum 103 is exposed to light by using light emitting elements such as LEDs or the like arranged along the rotational axis direction of the photosensitive drum 103 and thus is not used in the laser beam scanning exposure type described above.

The exposure unit 500 described in this embodiment is provided on a side below a rotational axis of the photosensitive drum 103 with respect to the vertical direction, and the photosensitive drum 103 is exposed to light from below by LEDs 503 of the optical print head 105. However, a constitution in which the exposure unit 500 is provided on a side above the rotational axis of the photosensitive drum 103 with respect to the vertical direction and in which the photosensitive drum 103 is exposed to light from above by the LEDs 503 of the optical print head 105 may also be employed. FIG. 3 is a schematic perspective view of the exposure unit 500 provided in the image forming apparatus 1 of this embodiment. Parts (a), (b1), (b2), (c1) and (c2) of FIG. 4 are schematic views for illustrating a substrate, an LED chip or a lens array of the optical print head 105.

Referring to FIG. 3, the exposure unit 500 includes the optical print head 105 and a moving mechanism 640. The optical print head 105 includes a lens array 506, a lens mounting portion 701, a holding member 505 for holding a substrate 502 (not shown in FIG. 3), a first contact member 514 (an example of a projection), a second contact member 515 (an example of a projection) and pin mounting portions 632 and 633 on which the first contact member 514 and the second contact member 515 are mounted, respectively. That is, in the following, it can also be said that members or the like inclined in the holding member 505 are included in the optical print head 105. Here, the first contact member 514 includes a first abutting portion 510 and a first projected portion 410, and the second contact member 515 includes a second abutting portion 511 and a second projected portion 411. The first abutting portion 510 refers to a portion, of the first contact member 514, projecting from an upper side (where the drum unit 518 is disposed) of the holding member 505, and the first projected portion 410 refers to a portion, of the first contact member 514, projecting from a lower side of the holding member 505. Similarly, the second abutting portion 511 refers to a portion, of the second contact member 515, projecting from the upper side (where the drum unit 518 is disposed) of the holding member 505 and the second projected portion 411 refers to a portion, of the second contact member 515, projecting from the lower side (opposite from the side where the drum unit 518 is disposed) of the holding member 505. Incidentally, in this embodiment, a structure in which a single metal pin (for example, the first contact member 514) includes the first abutting portion 510 and the first projected portion 410 is described, but the first abutting portion 510 and the first projected portion 410 may also be formed independently as separate members from each other as parts mounted to the holding member 505. That is, on one end side of the holding member 505, two pins including a first pin and a second pin are provided, and the first pin may perform a function corresponding to the first abutting portion 510 and the second pin may perform a function corresponding to the first projected portion 410.

During movement of the optical print head 105 by a moving mechanism 640 described later, the first abutting portion 510 and the second abutting portion 511 contact the drum unit 518. As a result, a gap (interval) is formed between the lens array 506 and the photosensitive drum 103, and thus a position of the optical print head 105 during image formation is determined. The moving mechanism 640 includes a first link mechanism 861, a second link mechanism 862 and a slidable portion 525. The first link mechanism 861 includes a link member 651 and a link member 653. The second link mechanism 862 includes a link member 652 and a link member 654. With an opening and closing operation of the unshown cover 558, the slidable portion 525 slides in the front-rear direction. In interrelation with the slide (movement) of the slidable portion 525, the first link mechanism 861 and the second link mechanism 862 are driven, so that the optical print head 105 is moved upward and downward. A specific operation of the moving mechanism will be described later.

In this embodiment, the first contact member 514 and the second contact member 515 are described as cylindrical pins. However, the shape of the pins is not limited to a cylindrical shape but may also be a prism shape. Further, the shape of the pins may also be a conical shape such that a diameter decreases toward a point. Further, the first and second contact members 514 and 515 are not limited to the pins but may also be projections integrally molded with the holding member 505.

For explaining a structure of the optical print head 105, first, the holding member 505 will be described. The holding member 505 is a holder for holding the substrate 502, the lens array 506 and the first and second contact members 514 and 515. A function of the first and second contact members 514 and 515 will be described specifically later. In the following, projection lengths of the first and second contact members 514 and 515 from the holding member 505 are summarized.

First contact member 514 (first abutting portion 510) projecting from upper surface of holding member 505: 7 mm Second contact member 515 (second abutting portion 511) projecting from upper surface of holding member 505: 11 mm First contact member 514 (first projected portion 410) projecting from lower surface of holding member 505: 22 mm Second contact member 515 (second projected portion 411) projecting from lower surface of holding member 505: 22 mm Next, the substrate 502 held by the holding member 505 will be described. Part (a) of FIG. 4 is a schematic perspective view of the substrate 502. Part (b1) of FIG. 4 is a schematic view showing an arrangement of a plurality of LEDs 503 provided on the substrate 502. Part (c) of FIG. 4 is an enlarged view of part (b1) of FIG. 4.

On the substrate 502, LED chips 639 are mounted. As shown in part (a) of FIG. 4, on one surface of the substrate 502, the LED chips 639 are provided, and on the other surface of the substrate 502, a connector 504 is provided. On the substrate 502, electrical wiring is provided for supplying signals to the respective LED chips 639. To the connector 504, one end of an unshown flexible flat cable (FFC) is connected. In the image forming apparatus 1 main assembly, a substrate including a controller and a connector is provided. The other end of the FFC is connected to the connector. To the substrate 502, a control signal is inputted from the controller of the image forming apparatus 1 main assembly through the FFC and the connector 504.

The LED chips 639 mounted on the substrate 502 will be described further specifically. As shown in parts (b1) and (b2) of FIG. 4, on one surface of the substrate 502, a plurality of LED chips 639-1 to 639-29 (29 LED chips) having a plurality of LEDs 503 (an example of the light emitting element) are disposed. On each of the LED chips 639-1 to 639-29, 516 LEDs 503 are arranged in a line along a longitudinal direction of the LED chips 639. With respect to the longitudinal direction of the LED chips 639, a center distance k2 between adjacent LEDs 503 corresponds to resolution of the image forming apparatus 1. The resolution of the image forming apparatus 1 is 1200 dpi, and therefore, in the longitudinal direction of the LED chips 639-1 to 639-29, the LEDs 503 are arranged in a line so that the center distance of the LEDs 503 is 21.16 μm. For that reason, an exposure range of the optical print head 105 in this embodiment is about 314 mm. A photosensitive layer on the photosensitive drum 103 is formed with a width of 314 mm or more. A long-side length of A4-size recording paper and a short-side length of A3-size recording paper are 297 mm, and therefore, the optical print head 105 in this embodiment has the exposure range in which the image can be formed on the A4-size recording paper and the A3-size recording paper.

The LED chips 639-1 to 639-29 are alternately disposed in two (parallel) lines along the rotational axis direction. That is, as shown in part (b1) of FIG. 4, odd-numbered LED chips 639-1, 639-3, . . . 639-29 counted from a left side are mounted on the substrate 502 in a line with respect to the longitudinal direction, and even-numbered LED chips 639-2, 639-4, . . . 639-28 counted from the left side are mounted on the substrate 502 in a line with respect to the longitudinal direction. By disposing the LED chips 639 in such a manner, as shown in part (b2) of FIG. 4, with respect to the longitudinal direction of the LED chips 639, a center distance k1 between one end of one (e.g., 639-1) of adjacent (different) LED chips 639 and the other end of the other one (e.g., 639-2) of the adjacent LED chips 639 can be made equal to the center distance k2 between the adjacent LEDs 503 on one (e.g., 639-1) of LED chips 503.

Incidentally, in this embodiment, a constitution using the LEDs 503 as an exposure light source is described as an example, but as the exposure light source, an organic EL (electro luminescence) device may also be used.

Next, a lens array 506 will be described. Part (c1) of FIG. 4 is a schematic view of the lens array 506 as seen from the photosensitive drum 103 side. Further, part (c2) of FIG. 4 is a schematic perspective view of the lens array 506. As shown in part (c1) of FIG. 4, a plurality of lenses are arranged in two lines along an arrangement direction of the plurality of LEDs 503. The respective lenses are alternately disposed so that with respect to an arrangement direction of the lenses arranged in one line, one of lenses arranged in the other line contacts both of adjacent lenses arranged in the arrangement direction of the lenses arranged in the above-described one line. Each of the lenses is a cylindrical rod lens made of glass. Incidentally, a material of the lens is not limited to glass but may also be plastics. Also shapes of the lenses are not limited to the cylindrical shape but may also be a polygonal prism shape such as a hexagonal prism shape.

A broken line Z shown in part (c2) of FIG. 4 represents an optical axis of the lens. The optical print head 105 is movable by the moving mechanism 640 in a direction (up-down direction) roughly along the optical axis of the lens indicated by the broken line Z. The optical axis of the lens referred to herein means a line connecting a center of a light emitting surface of the lens and a focus of the lens. Emitted light emitted from the LED 503 enters the lens of the lens array 506. The lens has a function of focusing the emitted light entering the lens on the surface of the photosensitive drum 103. A mounting position of the lens array 506 relative to the lens mounting portion 701 is adjusted during assembling of the optical print head 105 so that a distance between a light emitting surface of the LED 503 and a light incident surface of the lens and a distance between a light emitting surface of the lens and the surface of the photosensitive drum are substantially equal to each other.

(Moving Mechanism)

Next, necessity to move the optical print head 105 in the up-down direction and a structure of the optical print head 105 will be specifically described. FIG. 5 is a schematic view of the exposure unit 500 as seen from a right side. As described above, as regards the image forming apparatus 1 of this embodiment, the drum unit 518 can be exchanged. The exchange of the photosensitive drum 103 is carried out by dismounting the drum unit 518, to be exchanged, from the apparatus main assembly by moving the drum unit 518 toward a front side of the photosensitive drum 103 with respect to the rotational axis direction of the photosensitive drum 103. When the drum unit 518 is moved in a state in which the optical print head 105 is positioned in the neighborhood of the surface of the photosensitive drum 103, for example, the surface of the photosensitive drum 103 and the lens array 506 are in contact with each other, so that there is a liability that the surface of the photosensitive drum 103 is damaged. Further, there is also a liability that the lens array 506 contacts the frame or the like of the drum unit 518 and thus is damaged. For that reason, there is a need to provide a mechanism (moving mechanism 640) for reciprocating the optical print head 105 between an exposure position (part (a) of FIG. 5) where the photosensitive drum 103 is exposed to light with the LEDs 503 and a retracted position (part (b) of FIG. 5) retracted from the exposure position. When the slidable portion 525 is moved in an arrow A direction in a state in which the optical print head 105 is in the exposure position (part (a) of FIG. 5), the optical print head 105 is moved toward the retracted position (part (b) of FIG. 5). In other words, the moving mechanism 640 moves the optical print head 105 in a direction of being spaced from the photosensitive drum 103. On the other hand, when the slidable portion 525 is moved in an arrow B direction in a state in which the optical print head 105 is in the retracted position (part (b) of FIG. 5), the optical print head 105 is moved toward the exposure position (part (a) of FIG. 5). In other words, the moving mechanism 640 moves the optical print head 105 in a direction of approaching the photosensitive drum 103.

In the following, a structure of the moving mechanism 640 will be described specifically.

Part (a) of FIG. 6 is a schematic perspective view of the moving mechanism 640 when a front side of the moving mechanism 640 is seen from a left side, and part (b) of FIG. 6 is a schematic perspective view of the moving mechanism 640 when a rear side of the moving mechanism 640 is seen from a right side. The moving mechanism 640 includes the first link mechanism 861, the slidable portion 525 and a third supporting portion 526. The third supporting portion 526 includes a supporting shaft 531 and an E-shaped stopper ring 533. The supporting shaft 531 is inserted through openings provided in surfaces (left side surface and right side surface) which are opposed with respect to the left-right direction of the third supporting portion 526. Further, the supporting shaft 531 is retained by the E-shaped stopper ring 533 on an outside of the left side surface so as not to be disconnected through the opening of the third supporting portion 526. As a result, the supporting shaft 531 is fixed in a state in which the supporting shaft 531 connects the left side surface and the right side surface of the third supporting portion 526.

The slidable portion 525 is provided with an elongated hole 691 extending in the front-rear direction. The supporting shaft 531 is inserted into the elongated hole 691 and is loosely engaged in the elongated hole 691 with a gap of, e.g., about 0.1-0.5 mm with respect to the up-down direction. For that reason, the slidable portion 525 is slidable (movable) relative to the third supporting portion 526 in a distance corresponding to a length of the elongated hole 691 with respect to the front-rear direction in a state in which movement of the slidable portion 525 relative to the third supporting portion 526 with respect to the up-down direction is prevented.

The first link mechanism 861 includes the link member 651 and the link member 653. A length of the link member 653 with respect to the longitudinal direction is shorter than a length of the link member 651 with respect to the longitudinal direction, and the link members 651 and 653 constitute a link member of a λ type.

The first link mechanism 861 will be described using FIGS. 6 and 7. Part (a) of FIG. 7 is a schematic view of a cross-section of the first link mechanism 861 cut along the rotational axis direction in the left-right direction as seen from the right side. Each of the link members 651 and 653 is a single link member, but may also be constituted by combining a plurality of link members.

The link member 651 includes a bearing portion 610, a projection 655 and a connecting shaft portion 538. The bearing portion 610 is a cylindrical projection provided with a hollow hole and stands toward the right side on one end side of the link member 651 with respect to the longitudinal direction. The projection 655 is a cylindrical projection standing in the rotational axis direction of the link member 651 on the other end side of the link member 651 with respect to the longitudinal direction. This projection is mounted to the holding member 505 of the optical print head 105. The connecting shaft portion 538 is provided between the bearing portion 610 and the projection 655 with respect to the longitudinal direction of the link member 651.

The slidable portion 525 is provided with an engaging shaft portion 534. The engaging shaft portion 534 is a cylindrical projection standing from the slidable portion 525 in the left direction. The engaging shaft portion 534 forms a first connecting portion by being engaged rotatably in a hole of the bearing portion 610. That is, the link member 651 is rotatable about the first connecting portion relative to the slidable portion 525. Incidentally, in this embodiment, a constitution in which the engaging shaft portion 534 is provided on the link member 651 side and in which the bearing portion 610 is provided on the slidable portion 525 side may also be employed.

The link member 653 includes a connecting shaft portion 530. The connecting shaft portion 530 is provided on one end side of the link member 653 with respect to the longitudinal direction of the link member 653. The connecting shaft portion 530 is a cylindrical projection standing from the link member 653 toward the left side. The connecting shaft portion 530 is engaged rotatably in a hole formed in the third supporting portion 526 and forms a second connecting portion. In this embodiment, the connecting shaft portion 530 may also be provided on the third supporting portion 526, not the link member 653. That is, in the hole provided in the link member 653, the connecting shaft portion 530 provided on the third supporting portion 526 may also be engaged.

The link member 653 is provided with a circular hole formed on the other end side thereof with respect to the longitudinal direction. In the hole, the connecting shaft portion 538 of the link member 651 is rotatably engaged, so that the connecting shaft portion 538 and the hole of the link member 653 form a fourth connecting portion. That is, the link member 653 is rotatable about the third connecting portion relative to the third supporting portion 526 and is rotatable about the fourth connecting portion relative to the link member 651. In this embodiment, the connecting shaft portion 538 may also be provided on the link member 653, not the link member 651. That is, the connecting shaft portion 538 provided on the link member 653 may also be rotatably engaged in a hole formed in the link member 651.

A structure of the second link mechanism 862 is also similar to the above-described structure of the first link mechanism 861. The link members 652 and 654 of the second link mechanism 862 correspond to the link members 651 and 653, respectively, of the first link mechanism 861. Correspondingly to the first connecting portion, connecting portion between one end side portion of the link member 652 with respect to the longitudinal direction and the slidable portion 525 constitutes a second connecting portion. Incidentally, in the moving mechanism 640, either one of the link members 653 and 654 may also be omitted.

By the above constitution, when the slidable portion 525 is slid from the front side toward the rear side relative to the third supporting portion 526, the bearing portion 610 engaged with the engaging shaft portion 534 is slid together with the slidable portion 525 from the front side toward the rear side relative to the third supporting portion 526. As a result, when the first link mechanism 861 is seen from the rear side, the link member 651 is rotated about the engaging shaft portion 534 in the clockwise direction, and the link member 653 is rotated about the connecting shaft portion 530 in the counterclockwise direction. Therefore, the projection 655 is moved from the exposure position toward a retracted position.

On the other hand, when the slidable portion 525 is slid (moved) from the rear side toward the front side relative to the third supporting portion 526, the link members 651 and 653 are moved in a direction opposite to the arrow direction shown in part (a) of FIG. 7. When the slidable portion 525 is slid from the rear side toward the front side relative to the third supporting portion 526, the bearing portion 610 engaged with the engaging shaft portion 534 is slid together with the slidable portion 525 from the rear side toward the front side relative to the third supporting portion 526. As a result, as shown in part (a) of FIG. 7, when the first link mechanism 861 is seen from the rear side, the link member 651 is rotated about the engaging shaft portion 534 in the counterclockwise direction, and the link member 653 is rotated about the connecting shaft portion 530 in the clockwise direction. Therefore, the projection 655 is moved from the retracted position toward the exposure position.

Here, (1) a distance between a rotation center axis of the connecting shaft portion 538 and a rotation center axis of the beating portion 610 is L1, (2) a distance between the rotation center axis of the connecting shaft portion 538 and a rotation center axis of the connecting shaft portion 530 is L2, and (3) a distance between the rotation center axis of the connecting shaft portion 538 and a rotation center axis of the projection 655 is L3. In the moving mechanism 640, the first link member 651 forms Scott-Russel's mechanism in which L1, L2 and L3 are equal to each other (part (b) of FIG. 7), so that the projection 655 is vertically moved (along a broken line A in part (b) of FIG. 7) with respect to a slide (movement) direction of the engaging shaft portion 534, and therefore, in the above-described link mechanism, the optical print head 105 can be moved substantially in an optical axis direction of the lens.

Incidentally, in this embodiment, a structure in which a combination of the link member 651 (652) and the link member 653 (654) in the first link mechanism 861 (second link mechanism 862) is reversed with respect to the front-rear direction, i.e., a structure in which a full length of the link member 651 (652) is shorter than a full length of the link member 653 (654) and in which the link member 651 (652) is mounted between one end side and the other end side of the link member 653 (654) may also be used. In this case, when the slidable portion 525 is slid from the front side toward the rear side, the optical print head 105 is moved from the retracted position toward the exposure position, and when the slidable portion 525 is slid from the rear side toward the front side, the optical print head 105 is moved from the exposure position toward the retracted position. The cover 558 described later is connected with the slidable portion 525 and has a structure such that the slidable portion 525 is moved from the front side toward the rear side in interrelation with movement of the cover 558 from an open state toward a closed state and is moved from the rear side toward the front side in interrelation with movement of the cover 558 from the closed state toward the open state.

Further, the mechanism for moving the optical print head 105 is not limited to the moving mechanism 640 but may also be a moving mechanism 940 shown in FIG. 8. In the following, the moving mechanism 940 will be described using FIG. 8. Incidentally, members having functions substantially similar to the members constituting the moving mechanism 640 are described by adding thereto the same reference numerals or symbols and will be omitted from redundant description in some cases.

As shown in FIG. 8, a first cam portion 112 and a second cam portion 113 are provided on the front side and the rear side, respectively, of the slidable portion 525. Further, at a lower portion of a holding member 905 on the front side, a movement supporting portion 114 is provided, and at a lower portion of the holding member 905 on the rear side, a movement supporting portion 115 is provided. Each of the first and second cam portions 112 and 113 has an inclined surface descending from the rear side toward the front side.

Part (a) of FIG. 8 is a schematic view of the optical print head 105 located in the exposure position and the moving mechanism 940 as seen from the rear side. In the case where the optical print head 105 is in the exposure position, when the slidable portion 525 is slid from the front side toward the rear side relative to the third supporting portion 526, the first and second cam portions 112 and 113 are moved together with the slidable portion 525 from the front side toward the rear side relative to the third supporting portion 526. As a result, lower ends of the movement supporting members 114 and 115 provided on the holding member 905 are moved from the exposure position toward the retracted position along the first and second cam portions 112 and 113, respectively.

Part (b) of FIG. 8 is a schematic view of the optical print head 105 located in the retracted position and the moving mechanism 940 as seen from the rear side. In the case where the optical print head 105 is in the retracted position, when the slidable portion 525 is slid from the rear side toward the front side relative to the third supporting portion 526, the first and second cam portions 112 and 113 are moved together with the slidable portion 525 from the rear side toward the front side relative to the third supporting portion 526. As a result, lower ends of the movement supporting members 114 and 115 provided on the holding member 905 are moved from the retracted position toward the exposure position by being pushed upward by the first and second cam portions 112 and 113, respectively.

Here, the inclined surface of each of the first and second cam portions 112 and 113 may also descend from the front side toward the rear side. In this case, when the slidable portion 525 is slid from the front side toward the rear side, the optical print head 105 is moved from the retracted position toward the exposure position, and when the slidable portion 525 is slid from the rear side toward the front side, the optical print head 105 is moved from the exposure position toward the extracted position. The cover 558 described later has a structure such that the cover 558 is connected with the slidable portion 525 through a link mechanism, for example and the slidable portion 525 is moved from the front side toward the rear side in interrelation with movement of the cover 558 from the open state toward the closed state and is moved from the rear side toward the front side in interrelation with movement of the cover 558 from the closed state to the open state.

Part (a) of FIG. 9 is a schematic perspective view of a first supporting portion 527 to which a front side portion of the third supporting portion 526 is to be mounted. The first supporting portion 527 includes a first bearing surface 586, an opposing portion (wall portion) 127, a projection 601, a screw hole 602, positioning bosses 603 and 604, a screw hole 605 and a contact surface 681.

The first bearing surface 586 is a portion where a front side lower end of the holding member 505 moved from the exposure position toward the retracted position contacts the first bearing surface 586 from above with respect to the vertical direction. The holding member 505 contacts the first bearing surface 586, so that the optical print head 105 is placed in the retracted position.

The first supporting portion 527 is fixed to the front side plate 642. The front side plate 642 is provided with the positioning bosses 603 and 604 and a plurality of holes (not shown) corresponding to fixing bosses, respectively. The positioning bosses 603 and 604 are inserted in the holes provided in the front side plate 642. In that state, the first supporting portion 527 and the front side plate 642 are fixed with each other with screws passed through the screw holes 602 of the first supporting portion 527.

The wall portion 127 stands from the first supporting portion 527 toward the rear side so as to sandwich the first projected portion 410 with respect to the left-right direction (direction perpendicular to the movement direction of the optical print head 105 by the moving mechanism 640). Here, the first supporting portion 527 is fixed to the apparatus main assembly, and therefore, the wall portion 127 is also fixed to the apparatus main assembly. The wall portion 127 is provided at positions opposing left and rear side portions of the first projected portion 410, so that movement of the first projected portion 410 in the left-right direction is prevented. As a result, the front side portion of the holding member 505 to which the first projected portion 410 is fixed is also prevented from moving in the left-right direction. Movement of the optical print head 105 being moved in the left-right direction by the moving mechanism 640 is prevented, whereby movement of the optical print head 105 from the retracted position to the exposure position and movement of the optical print head 105 from the exposure position to the retracted position become easy. Thus, the wall portion 127 also has a function of guiding the movement of the optical print head 105 by the moving mechanism 640. Structural features of the wall portion 127 and the first projected portion 410 will be described specifically later.

Part (b) of FIG. 9 is a schematic view for illustrating a state in which the front side portion of the third supporting portion 526 is inserted into a portion enclosed by a broken line shown in part (a) of FIG. 9. Part (c) of FIG. 9 is a schematic view showing a state in which the front side portion of the third supporting portion 526 is inserted in the portion enclosed by the broken line shown in part (a) of FIG. 9. As shown in parts (b) and (c) of FIG. 9, the third supporting portion 526 is a metal plate bent in a channel shape. The third supporting portion 526 is provided with a cut-away portion on the front side thereof. The cut-away portion and the projection 601 of the first supporting portion 527 engage with each other, so that the position of the third supporting portion 526 relative to the first supporting portion 527 with respect to the left-right direction is determined. The third supporting portion 526 is fixed to the first supporting portion 527 by a screw inserted through the screw hole 602 in a state in which the third supporting portion 526 contacts the contact surface 681.

Part (a) of FIG. 10 is a schematic perspective view of a second supporting portion 528 to which a rear side portion of the third supporting portion 526 is to be mounted. The second supporting portion 528 includes a second bearing surface 587 and a wall portion 128.

The second bearing surface 587 has the same function as the above-described first bearing surface 586. To the second bearing surface 587, a rear side lower end of the holding member 505 moved from the exposure position toward the retracted position is contacted. That is, the holding member 505 of the optical print head 105 located in the retracted position is supported by the first bearing surface 586 and the second bearing surface 587.

The wall portion 128 (an example of the opposing portion) stands from the second supporting portion 528 toward the front side so as to sandwich the second projected portion 411 with respect to the left-right direction. The wall portion 128 is provided at positions opposing left and rear side portions of the second projected portion 411, so that movement of the second projected portion 411 in the left-right direction is prevented. As a result, the rear side portion of the holding member 505 to which the second projected portion 411 is fixed is also prevented from moving in the left-right direction. The wall portion 127 described above prevents the movement of the first projected portion 410 in the left-right direction, and the wall portion 128 prevents the movement of the second projected portion 411 in the left-right direction, so that the holding member 505 is prevented from moving in the left-right direction over the longitudinal direction thereof. That is, it is possible to reduce a degree of a liability that the optical print head 105 moves in the left-right direction during movement from the retracted position toward the exposure position. In order to obtain this effect, the wall portions 127 and 128 may preferably be provided on the first supporting portion 527 and the second supporting portion 528, respectively, but the wall portion may also be provided on either one of the first and second supporting portions 527 and 528.

As shown in part (b) of FIG. 10, the second supporting portion 528 is fixed to the front side surface of the rear side plate 643. The second supporting portion 528 is fixed to the rear side plate 643 by a positioning boss and a screw. The exposure unit 500 is inserted into an arrow direction shown in part (b) of FIG. 10 through an opening formed in the front side plate 642, so that the third supporting portion 526 is fixed to the second supporting portion 528.

Part (c) of FIG. 10 shows a state in which the rear side portion of the third supporting portion 528 is inserted in a portion enclosed by a broken line shown in part (a) of FIG. 10. The third supporting portion 526 is supported by the first supporting portion 527 on the front side and is supported by the second supporting portion 528 on the rear side. That is, both the first supporting portion 527 and the third supporting portion 528 are fixed to the image forming apparatus 1 main assembly. Therefore, the third supporting portion 526 is fixed to the image forming apparatus 1 main assembly and thus is not moved.

Incidentally, a constitution in which the second supporting portion 528 and the rear side plate 643 are not fastened with a screw may also be employed. In this case, for example, the second supporting portion 528 is provided with a recessed portion, and this recessed portion is engaged with a projected portion provided on the rear side plate 643, so that a structure in which a position of the second supporting portion 528 relative to the rear side plate 643 is determined is formed.

Next, the structural features of the wall portion 127 and the first projected portion 410 will be described.

Part (a) of FIG. 11 is a contact perspective view of the holding member 505 to which the first contact member 514 is mounted. Part (b) of FIG. 11 is a schematic perspective view of the first contact member 514. As shown in part (a) of FIG. 11, the first contact member 514 is mounted in a pin mounting portion 632 of the holding member 505 on one end side. An upper-side portion of the first contact member 514 projects from the upper side of the pin connecting portion 632 and forms the first abutting portion 510, and a lower-side portion of the first contact member 514 projects from the lower side of the pin mounting portion 632 and forms the first projected portion 410. Incidentally, although the second contact member 515 is not shown in the figure, also as regards the second contact member 515 mounted in a pin mounting portion 633 of the holding member 505 on the other end side, an upper-side portion of the second contact member 515 projects from the upper side of the pin mounting portion 633 and forms the second abutting portion 511, and a lower-side portion of the second contact member 515 projects from the lower side of the pin mounting portion 633 and forms the second projected portion 411. When the optical print head 105 located in the retracted position is moved toward the exposure position by the moving mechanism 640, a free end of the first abutting portion 510 and a free end of the second abutting portion 511 abut against the drum unit 518, so that the optical print head 105 is placed in the exposure position. Here, the drum unit 518 may also be provided with a hole against which the first abutting portion 510 abuts and in which the first abutting portion 510 engages and a hole against which the second abutting portion 511 abuts and in which the second abutting portion 511 engages.

Further, as shown in parts (a) and (b) of FIG. 11, at a lower end of the first contact member 514 (i.e., a free end of the first projected portion 410), a claw portion 512 (an example of a preventing portion) projects in a collar shape in a direction perpendicular to the longitudinal direction of the first contact member 514. In this embodiment, the first contact member 514 (second contact member 515) is a circular column-shaped pin, and therefore, the claw portion 512 has a structure such that the claw portion 512 projects in a radial direction with a longitudinal center axis of the circular column and a center, and is formed over an entire area of the first contact member 514 with respect to a circumferential direction.

Part (c) of FIG. 11 is a perspective view of a front side portion of the exposure unit 500 and the first supporting portion 527 provided with the first wall portion 127 when the optical print head 105 is in the exposure position.

As shown in part (c) of FIG. 11, the optical print head 105 is provided with the first contact member 514 and the holding member 505. On one end side of the holding member 505, the pin mounting portion 632 in which the first contact member 514 is mounted is provided. As described above, the optical print head 105 moved from the retracted position toward the exposure position by the moving mechanism 640 is disposed at the exposure position by contact of the first abutting portion 510 and the second abutting portion 511 (not shown in part (c) of FIG. 11) with the unshown drum unit 518. As shown in part (c) of FIG. 11, the first projected portion 410 moving together with the optical print head 105 reciprocating between the exposure position and the retracted position moves in the up-down direction in the gap formed by the wall portion 127, but the claw portion 512 is always positioned on a side below the wall portion 127. The projected portion 410 is always prevented from moving in the left-right direction by the wall portion 127. That is, movement of the holding member in the left-right direction is also prevented. Even when the optical print head is liable to tilt with respect to the left-right direction during movement of the optical print head 105 by the moving mechanism 640, the projected portion 410 contacts the wall portion 127. The movement of the projected portion 410 is guided by the wall portion 127, whereby the optical print head 105 can be moved between the retracted position and the exposure position with reliability.

In a state in which the first abutting portion 510 contacts the drum unit 518 and the optical print head 105 is disposed at the exposure position, the upper-side portion of the claw portion 512 and the wall portion 127 are in non-contact with each other. Further, as shown in part (a) of FIG. 11 the claw portion 512 crosses the wall portion 127 with respect to the up-down direction. The first projected portion 410 is provided with the claw portion 512, and therefore, even in the case where the operator closes the cover 558 in a state in which the operator dismounts the drum unit 518 from the apparatus main assembly (i.e., in a state in which there is no portion-to-be-abutted which is to be abutted by the first abutting portion 510), the upper-side portion of the claw portion 512 contacts the wall portion 127. That is, in the state in which the drum unit 518 is dismounted from the apparatus main assembly, when the optical print head 105 is moved by the moving mechanism 640 from the retracted position to the exposure position and then is further moved toward a downstream side with respect to the movement direction, the claw portion 512 contacts the wall portion 127. As a result, disengagement of the first contact member 514 from the wall portion 127 due to movement of the first projected portion 410 toward a side above the wall portion 127 can be prevented.

The wall portion 127 has an inclined shape in order to minimize a frictional force generating by contact thereof with the first projected portion 410, and a thickness thereof with respect to the up-down direction decreases toward the first projected portion 410. As a result, the first projected portion 410 can smoothly move in the up-down direction in the gap formed by the wall portion 127. A structure corresponding to the claw portion 512 provided on the first projected portion 410 may also be provided on the second projected portion 411.

Further, at least one of two wall portions 127 (examples of first wall portion and a second wall portion) provided on the both sides of the first projected portion 410 with respect to the left-right direction may also be provided with an elastic member such as a leaf spring, for example. By providing the wall portion 127 with the elastic member, the first projected portion 410 is always pressed toward either one direction of the left-right direction (in the case where the two wall portions 127 are provided with the elastic members, the first projected portion 410 is sandwiched by these elastic members). By employing such a structure, movement of the first projected portion 410 in the left-right direction can be prevented further reliably.

(Cartridge Cover)

Next, the cover 558 will be described using FIG. 12.

Part (a) of FIG. 12 is a perspective view of the cover 558 mounted to the moving mechanism 640 as seen from the right side, part (b) of FIG. 12 is a perspective view of the cover 558 mounted to the moving mechanism 640 as seen from the left side, part (c) of FIG. 12 is a perspective view for illustrating the front side plate 642 to which the cover 558 is mounted, and part (d) of FIG. 12 is a perspective view of the front side plate 642, in which the cover 558 is not shown. The operator such as a user or a service person can dismount the drum unit 518 from the apparatus main assembly by placing the cover 558 in an open state (part (c) of FIG. 12). The closed cover 558 positions on an insertion and extraction path of the drum unit 518 and the developing unit 641. For that reason, when the cover 558 is in a closed state, the operator cannot perform an exchanging operation of the drum unit 518 and the developing unit 641. The operator can exchange the drum unit 518 by opening the cover 558 and closing the cover 558 after an end of the operation.

As shown in parts (a) and (b) of FIG. 12, the cover 558 includes rotation shaft portions 559 and 560 and a pressing portion 561. The rotation shaft portion 559 is a circular column-shaped projection projecting toward the right side of the cover 558. On the other hand, the rotation shaft portion 560 is a circular column-shaped projection projecting toward the left side of the cover 558. Incidentally, a rotational axis 563 is a rotation center axis of the cover 558 rotatable about the rotation shaft portions 559 and 560.

As shown in part (b) of FIG. 12, the pressing portion 561 is positioned in a space provided on the front side of the slidable portion 525 in a state in which the cover 558 is mounted to the front side plate 642. When the cover 558 is rotated about the rotation axis 563, the pressing portion 561 moves the slidable portion 525 in the front-rear direction in interrelation with the rotation. Specifically, when the operator rotates the cover 558 from the closed state toward the open state, the pressing portion 561 moves the slidable portion 525 from the front side toward the rear side. In interrelation with this movement of the slidable portion 525 from the front side toward the rear side, the optical print head 105 moves from the exposure position toward the retracted position. That is, when the operator opens the cover 558, the optical print head 105 moves toward the retracted position, so that the gap between the photosensitive drum 103 and the optical print head 105 increases. As a result, the operator can perform the exchanging operation of the drum unit 518 without contacting the drum unit 518 to the optical print head 105. On the other hand, when the operator rotates the cover 558 from the open state toward the closed state, the pressing portion 561 moves the slidable portion 525 from the rear side toward the front side. In interrelation with this movement of the slidable portion 525 from the rear side toward the front side, the optical print head 105 moves from the retracted position toward the exposure position.

A constitution for sliding (moving) the slidable portion 525 is not limited to the cover 558. For example, a constitution in which the slidable portion 525 is slid in interrelation with opening and closing of an unshown front door may also be employed. Further, a constitution in which the slidable portion 525 is slid in interrelation with rotation of a rotatable member such as a lever, not a covering member such as the cover 558 or a door may also be employed.

As shown in parts (c) and (d) of FIG. 12, the front side plate 642 includes a bearing member 621 engageable with the rotation shaft portion 559 of the cover 558 and includes a bearing member 622 engageable with the rotation shaft portion 560 of the cover 558. Further, as shown in part (c) of FIG. 11, the rotation shaft portion 559 of the cover 558 rotatably engages with the bearing member 621 of the front side plate 642, and the rotation shaft portion 560 of the cover 558 rotatably engages with the bearing member 622 of the front side plate 642.

Embodiment 2

In Embodiment 1, as a structure for preventing the movement of the first projected portion 410, the wall portion 127 was described. As shown in part (a) of FIG. 9, the wall portion 127 stands from the first supporting portion 527 toward the rear side and forms a channel-like shape. On the other hand, in Embodiment 2, as shown in FIG. 13, a structure in which a through hole portion 125 containing a through hole in which the first projected portion 410 is engaged is provided on the first supporting portion 527 will be described. Incidentally, for description of Embodiment 2, constituent elements other than the through hole portion 125 formed on the first supporting portion 527 are similar to those in Embodiment 1, and therefore, will be omitted from detailed description by adding thereto the same reference numerals or symbols.

As shown in FIG. 13, the first supporting portion 527 in Embodiment 2 is provided with the through hole portion 125 containing the through hole penetrating the through hole portion 125 in the up-down direction. The first projected portion 410 engages in the through hole portion 125. At an inside portion of the through hole portion 125, wall portions 127 and wall portions 129 are formed. The wall portions 127 oppose each other with respect to the left-right direction, and the wall portions 129 oppose each other with respect to the front-rear direction. Similarly as in Embodiment 1, the claw portion 512 is always positioned on a side below the through hole portion 125 and crosses both of the wall portions 127 and the wall portions 129. As a result, even in the case where the operator closes the cover 558 in a state in which the operator dismounts the drum unit 518 from the apparatus main assembly (i.e., in a state in which there is no portion-to-be-abutted which is to be abutted by the first abutting portion 510), the upper-side portion of the claw portion 512 contacts either one or both of the wall portion 127 and the wall portion 129. As a result, disengagement of the first contact member 514 from the through hole portion 125 due to movement of the first projected portion 410 toward a side above the through hole portion 125 can be prevented.

Incidentally, the through hole of the through hole portion 125 is not required to be a hole enclosing a periphery of the first projected portion 410, but a constitution in which one of the two wall portions 127 (examples of the first wall portion and the second wall portion) opposing each other with respect to the left-right direction is removed may also be employed. In the case of this constitution, the second supporting portion 528 is provided with a hole portion which contains a through hole in which the second projected portion 411 engages and which corresponds to the through hole portion 125, so that the movement of the holding member 505 in the left-right direction can be prevented.

Further, at least one of two wall portions 129 provided on both sides of the first projected portion 410 with respect to the front-rear direction may also be provided with an elastic member such as a leaf spring, for example. By providing the wall portion 129 with the elastic member, the first projected portion 410 is always pressed toward either one direction of the front-rear direction (in the case where the two wall portions 129 are provided with the elastic members, the first projected portion 410 is sandwiched by these elastic members). By employing such a structure, movement of the first projected portion 410 in the front-rear direction can be prevented further reliably.

Modified Embodiment

In Embodiments 1 and 2, the claw portion 512 formed at the free end of the first projected portion 410 was described as a collar-shaped projection projecting from the first projected portion 410 in the direction perpendicular to the up-down direction. The shape of the claw portion 512 may also be a shape such that a claw portion is inclined so as to become thick toward a free end thereof. A modified embodiment of the claw portion 512 will be described using FIG. 14.

Part (a) of FIG. 14 is a schematic perspective view of the first contact member 514 provided with an inclined claw portion 522. Part (b) of FIG. 14 is a perspective view of a front side portion of the exposure unit 500 and the first supporting portion 527 provided with the first wall portion 127 when the optical print head 105 is in the exposure position.

As shown in part (b) of FIG. 14, the exposure unit 500 is provided with the first contact member 514 and the holding member 505. On one end side of the holding member 505, the pin mounting portion 632 in which the first contact member 514 is mounted is provided. As described above, the optical print head 105 moved from the retracted position toward the exposure position by the moving mechanism 640 is disposed at the exposure position by contact of the first abutting portion 510 and the second abutting portion 511 (not shown in part (b) of FIG. 14) with the unshown drum unit 518. As shown in part (b) of FIG. 14, the claw portion 522 is always positioned on a side below the wall portion 127.

In a state in which the first abutting portion 510 contacts the drum unit 518 and the optical print head 105 is disposed at the exposure position, the upper-side portion of the claw portion 522 and the wall portion 127 are in non-contact with each other. Further, as shown in part (b) of FIG. 14 the claw portion 522 crosses the wall portion 127 with respect to the up-down direction. The first contact member 514 is provided at a lower end thereof with the claw portion 522, and therefore, even in the case where the operator closes the cover 558 in a state in which the operator dismounts the drum unit 518 from the apparatus main assembly (i.e., in a state in which there is no portion-to-be-abutted which is to be abutted by the first abutting portion 510), the claw portion 522 contacts the wall portion 127. As a result, disengagement of the first contact member 514 from the wall portion 127 due to movement of the claw portion 522 toward a side above the wall portion 127 can be prevented.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-208426 filed on Oct. 27, 2017, which is hereby incorporated by reference herein in its entirety.

What is claimed is:

1. An image forming apparatus in which a drum cartridge including a rotatable photosensitive drum is capable of being mounted in and dismounted from a main assembly, said image forming apparatus comprising:

an optical print head including a light emitting element configured to emit light to which the photosensitive drum is exposed;

a moving mechanism configured to move said optical print head from a retracted position retracted from the photosensitive drum so as to allow exchange of the photosensitive drum toward a direction in which said optical print head approaches the photosensitive drum;

an abutting portion provided in said optical print head and configured to position said optical print head at an exposure position where the photosensitive drum is exposed to light emitted from said light emitting element, by being abutted against the drum cartridge in a mounted state in the main assembly during movement of said optical print head by said moving mechanism;

a projected portion extending from said optical print head toward a side opposite from a side where the drum cartridge is provided, said projected portion being provided on at least one of one end side and another end side of said optical print head with respect to a longitudinal direction of said optical print head;

an opposing portion fixed to the main assembly so as to oppose a part of said projected portion with respect to a perpendicular direction perpendicular to a movement direction of said optical print head moved by said moving mechanism, wherein said opposing portion guides movement of said optical print head in the movement direction by contact thereof with said projected portion with respect to the perpendicular direction during movement of said optical print head from the retracted position toward the exposure position; and a preventing portion provided on said projected portion so that in a state in which the drum cartridge is dismounted from the main assembly, said preventing portion is contacted to said opposing portion by movement of said optical print head moved by said moving mechanism toward a side downstream of the exposure position with respect to the movement direction and prevents further movement of said optical print head in the movement direction and so that in a state in which the drum cartridge is mounted in the main assembly and said abutting portion contacts the drum cartridge, said preventing portion is not in contact with said opposing portion.

2. An image forming apparatus according to claim 1, wherein said preventing portion is a projection projected from said projected portion in the perpendicular direction.

3. An image forming apparatus according to claim 2, wherein said abutting portion is provided on both of the one end side of said optical print head and the other end side of said optical print head with respect to the longitudinal direction of said optical print head.

4. An image forming apparatus according to claim 3, wherein said projected portion is provided on both of the one end side of said optical print head and the other end side of said optical print head with respect to the longitudinal direction of said optical print head.

5. An image forming apparatus according to claim 2, wherein said preventing portion is provided on a free end side of said projected portion.

6. An image forming apparatus according to claim 5, wherein said preventing portion has an inclined shape such that a width with respect to a direction perpendicular to the perpendicular direction increases toward a lower end thereof with respect to the perpendicular direction.

7. An image forming apparatus according to claim 1, wherein said projected portion is a circular column-shaped projection provided on the side opposite from the side where the drum cartridge is provided.

8. An image forming apparatus according to claim 1, wherein said opposing portion includes a first wall portion opposing said projected portion with respect to the perpendicular direction on one end side of said projected portion with respect to the perpendicular direction and includes a second wall portion opposing said projected portion with respect to the perpendicular direction on the other end side of said projected portion with respect to the perpendicular direction.

9. An image forming apparatus according to claim 8, wherein either one of said first wall portion and said second wall portion includes a leaf spring configured to urge said projected portion, positioned between said first wall portion and said second wall portion, toward the other of said first wall portion and said second wall portion.

10. An image forming apparatus according to claim 1, wherein said abutting portion is provided only on either one of the one end side of said optical print head and the other end side of said optical print head with respect to the longitudinal direction of said optical print head, wherein said projected portion is provided on a side, of the one end side of said optical print head and the other end side of said optical print head with respect to the longitudinal direction of said optical print head, where said abutting portion is provided, and wherein a single circular column-shaped metal pin fixed to said optical print head in a state in which said pin penetrates through said optical print head in the movement direction includes said abutting portion which is a portion projected from said optical print head toward a side where the drum cartridge is provided and includes said projected portion which is a portion projected from said optical print head toward a side opposite from the side where the drum cartridge is provided.

11. An image forming apparatus according to claim 10, wherein said preventing portion is formed over an entire region with respect to a circumferential direction of said projected portion.

12. An image forming apparatus according to claim 1, wherein said optical print head is provided below a rotational axis of the photosensitive drum with respect to a vertical direction, and said light emitting element exposes the photosensitive drum to light from below the photosensitive drum.

13. A image forming apparatus according to claim 1, wherein the drum cartridge is provided with a hole to which said abutting portion is contacted and in which said abutting portion is engaged.

* * * * *